US011445297B2

(12) United States Patent
Choi et al.

(10) Patent No.: US 11,445,297 B2
(45) Date of Patent: Sep. 13, 2022

(54) DISPLAY DEVICE

(71) Applicant: Samsung Display Co., LTD., Yongin-si (KR)

(72) Inventors: Si Young Choi, Asan-si (KR); Young Sik Kim, Yongin-si (KR); Jeong Heon Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 74 days.

(21) Appl. No.: 16/877,178

(22) Filed: May 18, 2020

(65) Prior Publication Data

US 2021/0076135 A1 Mar. 11, 2021

(30) Foreign Application Priority Data

Sep. 9, 2019 (KR) ..... 10-2019-0111638

(51) Int. Cl.
*H04R 3/12* (2006.01)
*H04R 1/40* (2006.01)
*H04R 1/02* (2006.01)

(52) U.S. Cl.
CPC ..... *H04R 3/12* (2013.01); *H04R 1/028* (2013.01); *H04R 1/403* (2013.01); *H04R 2499/15* (2013.01)

(58) Field of Classification Search
CPC ..... H04R 3/12; H04R 2499/15; H04R 1/02; H04R 5/02
USPC ..... 381/333, 388, 396, 401, 87
See application file for complete search history.

(56) References Cited

U.S. PATENT DOCUMENTS

| | | | | |
|---|---|---|---|---|
| 9,092,197 | B2 * | 7/2015 | Sim | G06F 1/1688 |
| 9,215,528 | B2 * | 12/2015 | Jia | H04R 5/04 |
| 9,241,217 | B2 * | 1/2016 | Rodgers | G06F 1/1688 |
| 10,595,109 | B2 * | 3/2020 | Shin | G06F 1/1688 |
| 10,771,730 | B2 * | 9/2020 | Lee | H01L 27/3225 |
| 11,314,476 | B2 * | 4/2022 | Park | H04R 5/02 |
| 2013/0038726 | A1 * | 2/2013 | Kim | H04R 3/12 348/143 |
| 2018/0035208 | A1 * | 2/2018 | Choi | H04R 1/028 |
| 2019/0037164 | A1 * | 1/2019 | Kim | H04N 5/642 |

FOREIGN PATENT DOCUMENTS

| | | | |
|---|---|---|---|
| KR | 1020140119474 | A | 10/2014 |
| KR | 101684141 | B1 | 12/2016 |
| KR | 1020200021026 | A | 2/2020 |

* cited by examiner

*Primary Examiner* — Disler Paul
(74) *Attorney, Agent, or Firm* — Cantor Colburn LLP

(57) ABSTRACT

A display device includes a display panel including a main area, a first subsidiary area extending from a first side of the main area, and a second subsidiary area extending from a second side of the main area, and a first sound generator disposed on the first subsidiary area and the second subsidiary area of the display panel, where the first sound generator generates a sound by vibrating the first subsidiary area and the second subsidiary area of the display panel.

22 Claims, 26 Drawing Sheets

DA: DA0, DA1, DA2, DA3, DA4
1: DA, NDA
1: 10, 11, 12, 13, 14

DISPLAY DEVICE

This application claims priority to Korean Patent Application No. 10-2019-0111638, filed on Sep. 9, 2019, and all the benefits accruing therefrom under 35 U.S.C. § 119, the content of which in its entirety is herein incorporated by reference.

BACKGROUND

1. Field

The disclosure relates to a display device.

2. Description of the Related Art

As the information-oriented society evolves, demands for various display devices are increasing. For example, display devices are widely employed in various electronic devices such as smart phones, digital cameras, laptop computers, navigation devices, and smart televisions. Such a display device may include a display panel for displaying an image and a sound generator for providing sound.

SUMMARY

When a display device is employed in various electronic devices, the display device may be desired to have various designs. For example, a display device for a smartphone may be desired to have a wider display area by way of eliminating a call receiver that outputs a voice of a person who a user is calling to in a sound mode.

Embodiments of the disclosure provide a display device capable of outputting sound by using a sound generator that is not exposed to an outside.

According to an exemplary embodiment of the disclosure, a display device includes a display panel including a main area, a first subsidiary area extending from a first side of the main area, and a second subsidiary area extending from a second side of the main area; and a first sound generator disposed on the first subsidiary area and the second subsidiary area of the display panel, where the first sound generator generates a sound by vibrating the first subsidiary area and the second subsidiary area of the display panel.

In an exemplary embodiment, the first sound generator may be bent at least once.

In an exemplary embodiment, the first side and the second side of the main area may not face each other.

In an exemplary embodiment, the display panel may further include a third subsidiary area extending from a third side of the main area which faces the second side, and the display device further comprises a second sound generator disposed on the first subsidiary area and the third subsidiary area of the display panel, where the third sound generator generate a sound by vibrating the first subsidiary area and the third subsidiary area of the display panel.

In an exemplary embodiment, the first sound generator may be spaced apart from the second sound generator.

In an exemplary embodiment, the display device may include a first connection film which connects the first sound generator and the second sound generator to each other.

In an exemplary embodiment, the display panel may further include a fourth subsidiary area extending from a fourth side of the main area which faces the first side, and the display device may further include a third sound generator disposed on the second subsidiary area and the fourth subsidiary area of the display panel, where the third sound generator generates a sound by vibrating the second subsidiary area and the fourth subsidiary area of the display panel.

In an exemplary embodiment, the display device may further include a second connection film which connects the first sound generator and the third sound generator to each other.

In an exemplary embodiment, the display device may further include a fourth sound generator disposed on the third subsidiary area and the fourth subsidiary area of the display panel, where the fourth sound generator generates a sound by vibrating the third subsidiary area and the fourth subsidiary area of the display panel.

In an exemplary embodiment, the display device may further include a third connection film which connects the second sound generator and the fourth sound generator to each other.

In an exemplary embodiment, the display device may further include a fourth connection film which connects the third sound generator and the fourth sound generator to each other.

In an exemplary embodiment, the display device may further include a circuit board disposed on a pad area extending from one of the first to fourth subsidiary areas of the display panel; and a plurality of connection films which connects the first to fourth sound generators to one another. In such an embodiment, the plurality of connection films may include a first connection film which connects the first sound generator and the second sound generator to each other, a second connection film which connects the first sound generator and the third sound generator to each other, a third connection film which connects the second sound generator and the fourth sound generator to each other, and a fourth connection film which connects the third sound generator and the fourth sound generator to each other. In such an embodiment, the display device may further include a first connection circuit film which connects the circuit board to one of the first to fourth connection films.

In an exemplary embodiment, the display device may further include a circuit board disposed on a pad area extending from one of the first to fourth subsidiary areas of the display panel, a first connection film which connects the first sound generator and the second sound generator to each other, a second connection film which connects the third sound generator and the fourth sound generator to each other, a first connection circuit film which connects the circuit board to the first connection film, and a second connection circuit film which connects the circuit board to the second connection film.

In an exemplary embodiment, the display device may further include a circuit board disposed on a pad area extending from one of the first to fourth subsidiary areas of the display panel, a first connection film which connects the first sound generator and the third sound generator to each other, a second connection film which connects the second sound generator and the fourth sound generator to each other, a first connection circuit film which connects the circuit board to the first connection film, and a second connection circuit film which connects the circuit board to the second connection film.

In an exemplary embodiment, the display device may further include a first connection film which connects the first sound generator and the second sound generator to each other, and a second connection film which connects the third sound generator and the fourth sound generator to each other.

In an exemplary embodiment, the display device may further include a first sound driving circuit which generates first sound driving voltages, a second sound driving circuit which generates second sound driving voltages, a first connection circuit film which connects the first sound driving circuit to the first connection film, and a second connection circuit film which connects the second sound driving circuit to the second connection film.

According to another exemplary embodiment of the disclosure, a display device includes a display panel including a main area, a first subsidiary area extending from a first side of the main area, and a second subsidiary area extending from a second side of the main area, and a first sound generator including a first first subsidiary sound generator disposed on the first subsidiary area of the display panel, where the first first subsidiary sound generator generates a sound by vibrating the first subsidiary area of the display panel, and a second first subsidiary sound generator disposed on the second subsidiary area of the display panel where the second first subsidiary sound generator generates a sound by vibrating the second subsidiary area of the display panel.

In an exemplary embodiment, the first first subsidiary sound generator may be spaced apart from the second first subsidiary sound generator.

In an exemplary embodiment, the display device may further include a first subsidiary connection film which connects the first first sound subsidiary generator and the second first sound subsidiary generator to each other.

In an exemplary embodiment, the display panel may further include a first corner portion where the first subsidiary area of the display panel meets the second subsidiary area of the display panel, and the first first subsidiary sound generator may be disposed on the first subsidiary area of the first corner portion, and the second first subsidiary sound generator may be disposed on the second subsidiary area of the first corner portion.

In an exemplary embodiment, the display panel may further include a third subsidiary area extending from a third side of the main area that faces the second side, and the display device may further include a second sound generator. In such an embodiment the second sound generator may include a first second subsidiary sound generator disposed on the third subsidiary area of the display panel where the first second subsidiary sound generator may generate a sound by vibrating the third subsidiary area of the display panel, and a second second subsidiary sound generator disposed on the first subsidiary area of the display panel where the second second subsidiary sound generator may generate a sound by vibrating the first subsidiary area of the display panel.

In an exemplary embodiment, the display device may further include a first subsidiary connection film which connects the first first subsidiary sound generator and the second first subsidiary sound generator to each other, a second subsidiary connection film which connects the first second subsidiary sound generator and the second second subsidiary sound generator to each other, a first connection film which connects the second first subsidiary sound generator with the first second subsidiary sound generator to each other, where the second first subsidiary sound generator may be spaced apart from the first second subsidiary sound generator.

According to exemplary embodiments of the disclosure, a sound generator is disposed on an inner surface of a subsidiary area of a display panel of a display device, and sound driving voltage of a sound driving circuit is applied to the sound generator to vibrate the subsidiary area of the display panel in the thickness direction of the subsidiary area, to output a sound.

According to exemplary embodiments of the disclosure, a plurality of sound generators is disposed on inner surfaces of subsidiary areas of a display panel of a display device, and the sound generators are electrically connected to one another through connection films, thereby driving the plurality of sound generators altogether by a single sound driving circuit. Therefore, the sound pressure may be improved by arranging the plurality of sound generators on the subsidiary areas of the display panel, and the number of the sound driving circuits may be reduced by driving the sound generators by a single sound driving circuit.

According to exemplary embodiments of the disclosure, pairs of sound generators are electrically connected to each other through the connection films, and the pairs of the sound generators may be driven independently of each other by a plurality of sound driving circuits, thereby effectively providing stereo sound.

BRIEF DESCRIPTION OF THE DRAWINGS

The above and other features of the invention will become more apparent by describing in detail exemplary embodiments thereof with reference to the attached drawings, in which.

DETAILED DESCRIPTION

Figure 1:
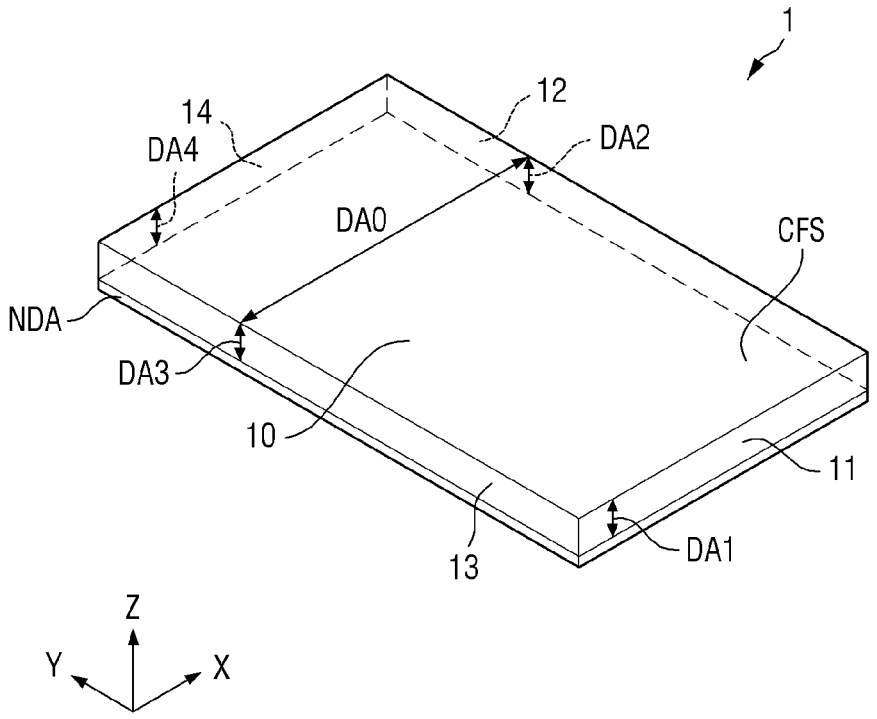
FIG. 1 is a perspective view of a display device according to an exemplary embodiment of the disclosure.

The invention will now be described more fully hereinafter with reference to the accompanying drawings, in which various embodiments are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will also be understood that when a layer is referred to as being "on" another layer or substrate, it can be directly on the other layer or substrate, or intervening layers may also be present. In contrast, when an element is referred to as being "directly on" another element, there are no intervening elements present.

It will be understood that, although the terms "first," "second," "third" etc. may be used herein to describe various elements, components, regions, layers and/or sections these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the disclosure will be described with reference to the accompanying drawings.

Figure 2:
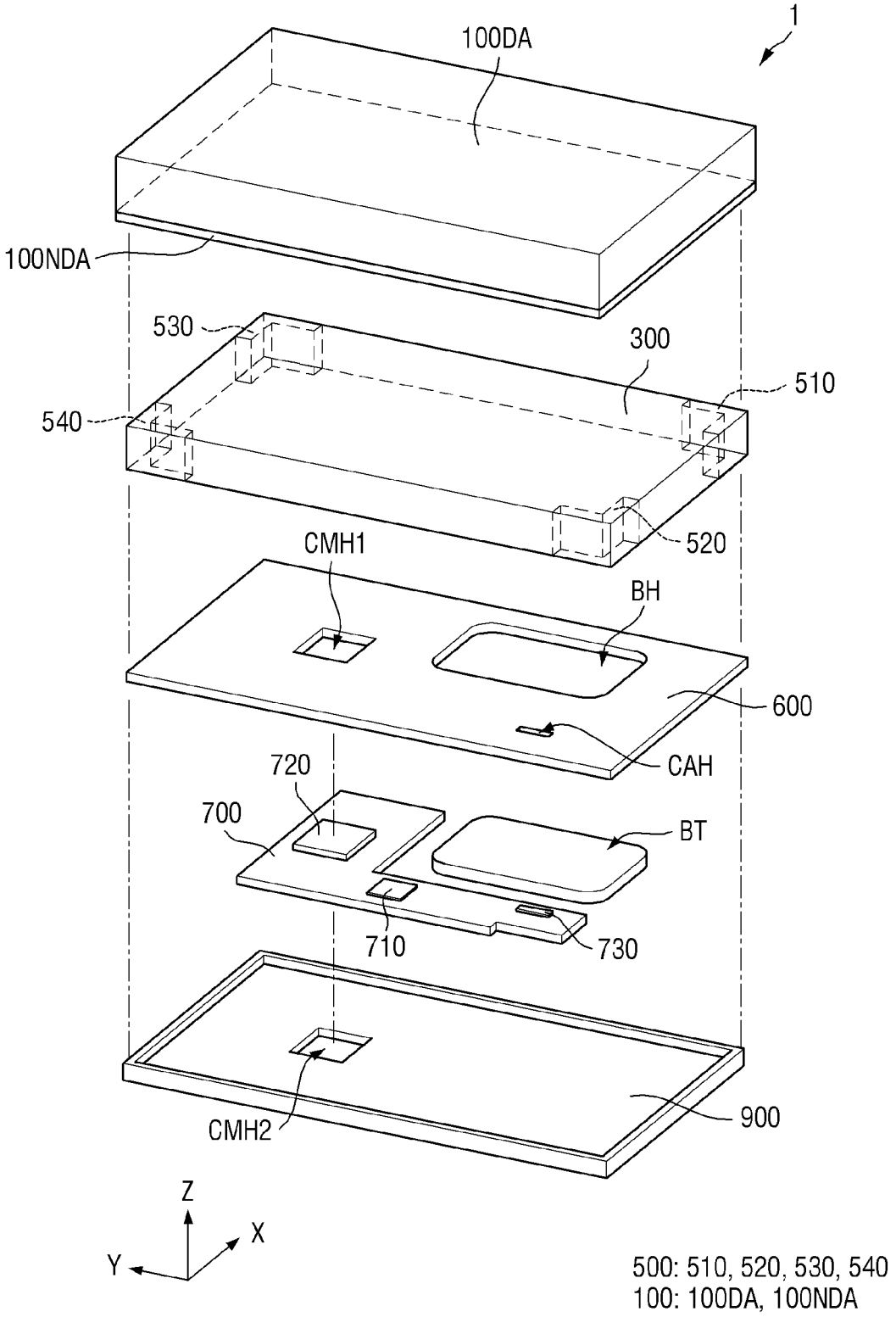
FIG. 2 is an exploded perspective view of a display device according to an exemplary embodiment of the disclosure.
Figure 3:
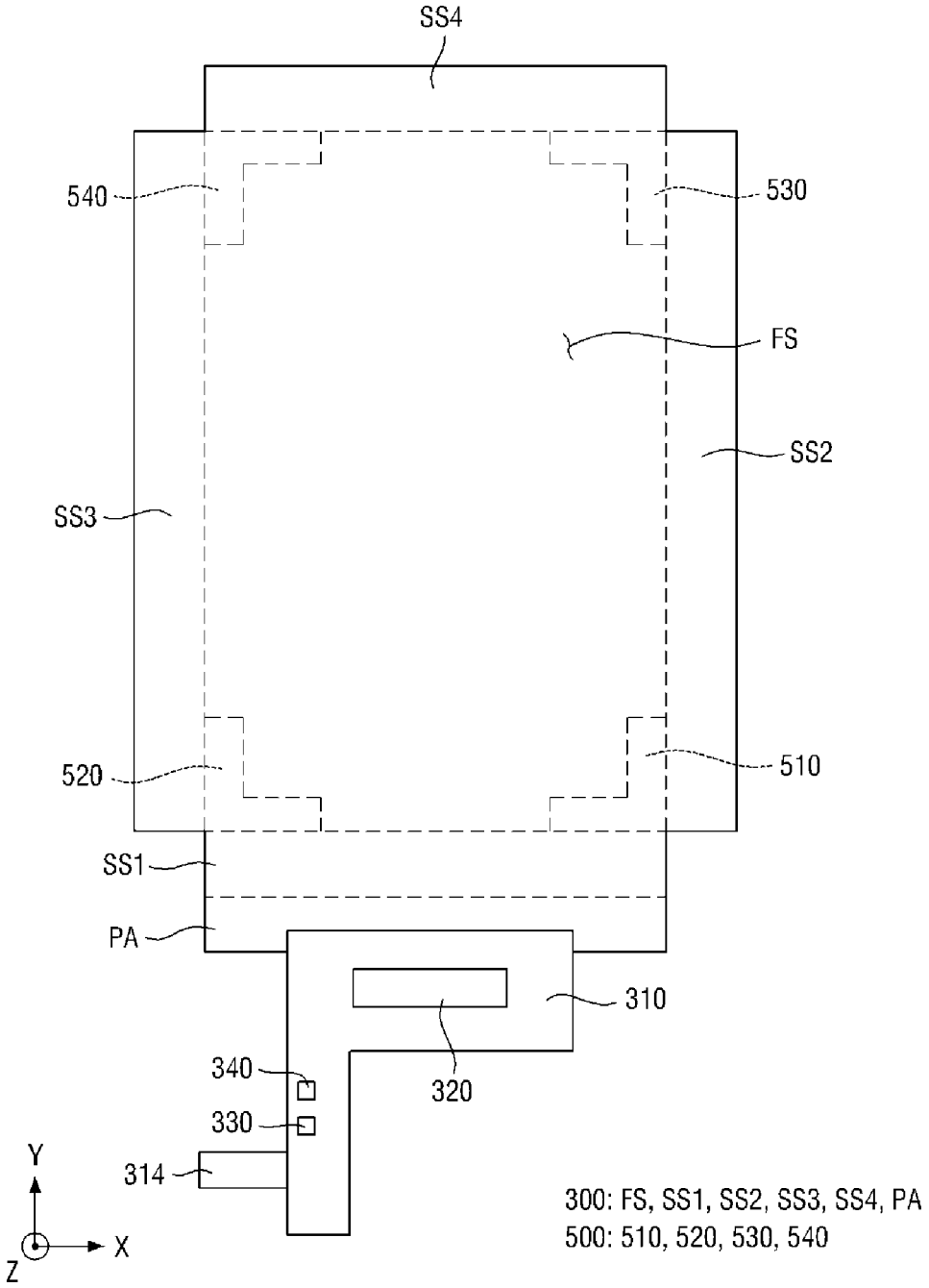
FIG. 3 is a development view showing an exemplary embodiment of the display panel of FIGS. 1 and 2.
Figure 4:
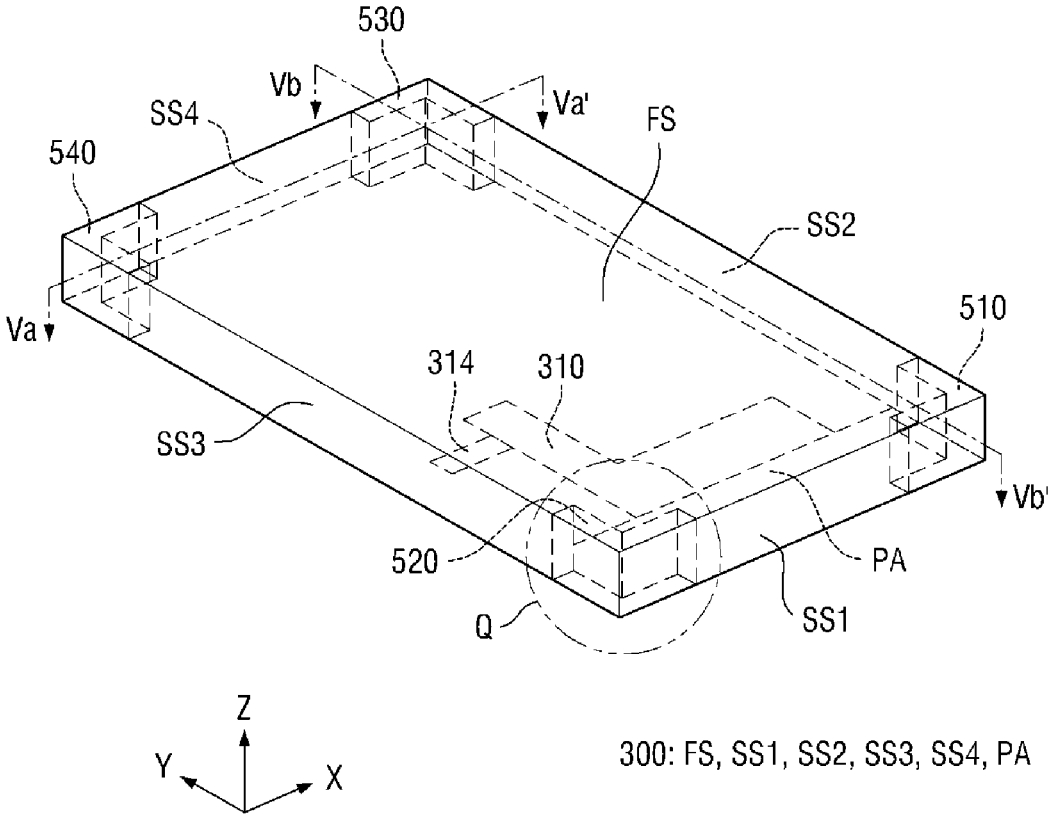
FIG. 4 is a perspective view of a display panel and sound generators according to an exemplary embodiment of the disclosure.

FIG. 1 is a perspective view of a display device according to an exemplary embodiment of the disclosure. FIG. 2 is an exploded perspective view of a display device according to an exemplary embodiment of the present disclosure. FIG. 3 is a development view showing an exemplary embodiment of the display panel of FIGS. 1 and 2. FIG. 4 is a perspective view of a display panel and sound generators according to an exemplary embodiment of the disclosure.

Referring to FIGS. 1 and 2, a display device 1 may display images. The display device 1 may include devices for providing a display screen, such as a mobile phone, a smart phone, a tablet personal computer ("PC"), an electronic watch, a smart watch, a watch phone, a mobile communications terminal, an electronic notebook, an electronic book, a portable multimedia player ("PMP"), a navigation device for vehicles, a game console, a digital camera, a television set, a laptop computer, a monitor, an electronic billboard, and the Internet of Things ("IoT") devices.

In an exemplary embodiment, as shown in FIGS. 1 to 3, the display device 1 includes a cover window 100, a display panel 300, a display circuit board 310, sound generators 500, a bracket 600, a main circuit board 700, and a bottom cover 900.

As used herein, the term "top side" refers to the side of the display panel 300 in the Z-axis direction where the cover window 100 is disposed, whereas the term "bottom side" refers to the opposite side of the display panel 300 in the Z-axis direction where the bracket 600 is disposed. As used herein, the terms "left," "right," "upper" and "lower" sides indicate relative positions when the display panel 300 is viewed from a top plan view. For example, the "left side" refers to the opposite direction indicated by the arrow of the X-axis, the "right side" refers to the direction indicated by the arrow of the X-axis, the "upper side" refers to the direction indicated by the arrow of the Y-axis, and the "lower side" refers to the opposite direction indicated by the arrow of the Y-axis.

The display device 1 may have a rectangular shape when viewed from the top plan view or a plan view in the Z-axis direction. In one exemplary embodiment, for example, the display device 1 may have a rectangular shape having shorter sides in a first direction (X-axis direction) and longer sides in a second direction (Y-axis direction) when viewed from the top as shown in FIG. 1. Each of the corners where the short side in the first direction (X-axis direction) meets the longer side in the second direction (Y-axis direction) may be formed at a right angle or may be rounded with a predetermined curvature. The shape of the display device 1 when viewed from the top plan view is not limited to a rectangular shape, but may be variously modified to be in another polygonal shape, a circular shape, or an elliptical shape.

The display device 1 may include a main display surface 10 and subsidiary display surfaces 11 to 14 extending from the upper, lower, left, and right sides of the main display surface 10, respectively.

The main display surface 10 of the display device 1 may have a generally plate shape, may be located on a plane of the display device 1, and may have the largest area (or size) among the main display surface 10 and the subsidiary display surfaces 11 to 14. The main display surface 10 may be located on the top surface of the display device 1. In an exemplary embodiment, the shape of the main display surface 10 may be substantially identical to the shape of the display device 1 when viewed from the top plan view. In one exemplary embodiment, for example, when the display device 1 has a rectangular shape having shorter sides in the first direction and longer sides in the second direction, the main display surface 10 may also have a rectangular shape having shorter sides in the first direction and longer sides in the second direction. It is, however, to be understood that the disclosure is not limited thereto. The shape of the main display surface 10 of the display device 1 may be different from the shape of the display device 1 when viewed from the top plan view. In one exemplary embodiment, for example, the main display surface 10 of the display device 1 may have a polygonal shape such as a rectangle, a circular shape, an elliptical shape, etc., when viewed from the top plan view.

The subsidiary display surfaces 11 to 14 of the display device 1 may be located on planes different from the plane on which the main display surface 10 of the display device 1 is located. Each of the subsidiary display surfaces 11 to 14 may have an area smaller than that of the main display surface 10, and the subsidiary display surfaces 11 to 14 may be disposed on different planes. The subsidiary display surfaces 11 to 14 may be connected to the sides of the main display surface 10, respectively, and may extend from the upper, lower, left and right sides of the main display surface 10, respectively, to be bent from the main display surface 10 (or the sides of the main display surface 10). In one exemplary embodiment, for example, where the main display surface 10 has a rectangular shape, the display device 1 may include first to fourth subsidiary display surfaces 11 to 14, and the first to fourth subsidiary display surfaces 11 to 14 may be connected to four sides of the main display surface 10 having the rectangular shape, respectively.

The first subsidiary display surface 11 may be connected to a first shorter side of the main display surface 10 and may be bent or curved therefrom. The first subsidiary display surface 11 may be bent in the vertical direction from the main display surface 10 and may be a surface perpendicular to the main display surface 10. The first subsidiary display surface 11 may define a first side surface (or lower side surface) of the display device 1.

The second subsidiary display surface 12 may be connected to a first longer side of the main display surface 10 and may be bent or curved therefrom. The second subsidiary display surface 12 may be bent in the vertical direction from the main display surface 10 and may be a surface perpendicular to the main display surface 10. The second subsidiary display surface 12 may define a second side surface (or right side surface) of the display device 1.

The third subsidiary display surface 13 may be connected to a second longer side of the main display surface 10 and may be bent or curved therefrom. The third subsidiary display surface 13 may be bent in the vertical direction from the main display surface 10 and may be a surface perpendicular to the main display surface 10. The third subsidiary display surface 13 may define a third side surface (or left side surface) of the display device 1.

The fourth subsidiary display surface 14 may be connected to a second shorter side of the main display surface 10 and may be bent or curved therefrom. The fourth subsidiary display surface 14 may be bent in the vertical direction from the main display surface 10 and may be a surface perpendicular to the main display surface 10. The fourth subsidiary display surface 14 may define a fourth side surface (or upper side surface) of the display device 1.

Hereinafter, for convenience of description, exemplary embodiments where the planes formed by the subsidiary display surfaces 11 to 14 and the plane formed by the main display surface 10 are perpendicular to each other will be described in detail. It is, however, to be understood that the disclosure is not limited thereto. In exemplary embodiments of the disclosure, the angles formed by the subsidiary display surfaces 11 to 14 and the plane formed by the main display surface 10 may be variously modified, e.g., to be an obtuse angle.

The display device 1 may be a three-dimensional display device that displays image on the top surface of the display device 1 as well as the side surfaces connected thereto. In one exemplary embodiment, for example, image may be displayed on the main display surface 10 that is located on the top surface of the display device 1 and the subsidiary display surfaces 11 to 14 extending from the upper, lower, left and right sides of the main display surface 10, respectively. The display device 1 may include a display area DA and a non-display area NDA. The display area DA is an area for displaying images and may include a pixel PX (see FIG. 9) which is a minimum light-emitting unit for displaying an image. The non-display area NDA does not display an image and may not include the pixel PX (see FIG. 9). The pixels PX will be described later in detail with reference to FIG. 9.

The display area DA may include a main display area DA0 and first to fourth sub display areas DA1 to DA4.

The main display area DA0 may be located on the main display surface 10. In one exemplary embodiment, for example, the main display surface 10 may include only the main display area DA0. The first subsidiary display area DA1 may be located on the first subsidiary display surface 11, and the first subsidiary display area DA1 may be connected to the main display area DA0. The second subsidiary display area DA2 may be located on the second subsidiary display surface 12, and the second subsidiary display area DA2 may be connected to the main display area DA0. The third subsidiary display area DA3 may be located on the third subsidiary display surface 13, and the third subsidiary display area DA3 may be connected to the main display area DA0.

In an exemplary embodiment of the display device 1, as shown in FIG. 1, the non-display area NDA may be disposed along the edges of the display area DA (the outermost edges of all of the subsidiary display surfaces 11 to 14. In the non-display area NDA, driving lines, driving circuits, etc. may be disposed. The non-display area NDA may include, but is not limited to, a black matrix which blocks light leakage, a decoration ink, etc.

The cover window 100 may be disposed on the display panel 300 to cover the upper surface of the display panel 300. Thus, the cover window 100 can protect the upper surface of the display panel 300.

The cover window 100 may include a transmissive portion 100DA covering the display panel 300 and a non-transmissive portion 100NDA covering the other areas than the display panel 300. The cover window 100 may be disposed on (or to cover) the display area DA and a part of the non-display area NDA of the display device 1. The transmissive portion 100DA may be located in the main display area DA0 and the first to fourth subsidiary display areas DA1 to DA4 of the display device 1. The non-transmissive portion 100NDA may be located in the non-display area NDA of the display device 10. The non-transmissive portion 100NDA may be opaque. Alternatively, the non-transmissive portion 100NDA may be defined as a decoration layer having a pattern that may be displayed to the user when no image is displayed. In one exemplary embodiment, for example, a company logo or a variety of letters may be patterned in the non-transmissive portion 100NDA.

The display panel 300 may be disposed under the cover window 100. The display panel 300 may overlap the transmissive portion 100DA of the cover window 100. The display panel 300 may be disposed in the main display area DA0 and the first to fourth subsidiary display areas DA1 to DA4 of the display device 1. Accordingly, the images on the display panel 300 may be seen not only in the main display area DA0 but also in the first to fourth subsidiary display areas DA1 to DA4.

The display panel 300 may be a light-emitting display panel including light-emitting elements. In one exemplary embodiment, for example, the display panel 300 may be an organic light-emitting display panel including organic light-emitting diodes including organic emissive layer, a micro light-emitting diode display panel including micro LEDs, a quantum-dot light-emitting display panel including quantum-dot light-emitting diodes including an quantum-dot emissive layer, or an inorganic light-emitting display panel using inorganic light-emitting elements including an inorganic semiconductor. Hereinafter, for convenience of description, exemplary embodiments where the display panel 300 is an organic light-emitting display panel will be described in detail.

Referring to FIGS. 3 and 4, the display panel 300 may include a main area FS, subsidiary areas SS1, SS2, SS3 and SS4 extending from the upper, lower, left and right sides of the main area FS, and a pad area PA.

The main area FS of the display panel 300 may have a substantially plate shape and may be substantially a same shape as that of the main display surface 10 of the display device 1. According to an exemplary embodiment of the disclosure, where the main display surface 10 of the display device 1 has a rectangular shape having shorter sides in the first direction and longer sides in the second direction when viewed from the top plan view, the main area FS of the display panel 300 may also have a rectangular shape having shorter sides in the first direction and longer sides in the second direction.

The subsidiary areas SS1, SS2, SS3 and SS4 of the display panel 300 may be positioned on planes different from the plane where the main area FS of the display panel 300 is located. The subsidiary areas SS1, SS2, SS3 and SS4 of the display panel 300 may be connected to the sides of the main area FS of the display panel 300, respectively, and may extend from the upper, lower, left and right sides of the main area FS of the display panel 300 to be bent in the vertical direction so that they are perpendicular to the main area FS of the display panel 300. According to an exemplary embodiment of the disclosure, the shape of the main area FS of the display panel 300 may be rectangular when viewed from the top plan view, the subsidiary areas SS1, SS2, SS3 and SS4 of the display panel 300 may include the first subsidiary area SS1, the second subsidiary area SS2, the third subsidiary area SS3 and the fourth subsidiary area SS4 may extend from the four sides of the main area FS of the display panel 300.

The first subsidiary area SS1 of the display panel 300 may be connected to the first shorter side of the display panel 300 and may extend from the first side (or lower side) of the main area FS of the display panel 300. The first subsidiary area SS1 of the display panel 300 may be the lower portion of the display panel 300. The first subsidiary area SS1 of the display panel 300 may have a quadrangular shape having shorter sides in the third direction (Z-axis direction) and longer sides in the first direction (X-axis direction).

The second subsidiary area SS2 of the display panel 300 may be connected to the first shorter side of the display panel 300 and may extend from the second side (or right side) of the main area FS of the display panel 300. The second subsidiary area SS2 of the display panel 300 may be the right portion of the display panel 300. The second subsidiary area SS2 of the display panel 300 may have a quadrangular shape having shorter sides in the third direction (Z-axis direction) and longer sides in the second direction (Y-axis direction).

The third subsidiary area SS3 of the display panel 300 may be connected to the second longer side of the display panel 300 and may extend from the third side (or left side) of the main area FS of the display panel 300. The third subsidiary area SS3 of the display panel 300 may be the left portion of the display panel 300. The third subsidiary area SS3 of the display panel 300 may have a quadrangular shape having shorter sides in the third direction (Z-axis direction) and longer sides in the second direction (Y-axis direction).

The fourth subsidiary area SS4 of the display panel 300 may be connected to the second shorter side of the display panel 300 and may extend from the fourth side (or upper side) of the main area FS of the display panel 300. The fourth subsidiary area SS4 of the display panel 300 may be the upper portion of the display panel 300. The fourth subsidiary area SS4 of the display panel 300 may have a quadrangular shape having shorter sides in the third direction (Z-axis direction) and longer sides in the first direction (X-axis direction).

The first subsidiary area SS1 and the fourth subsidiary area SS4 of the display panel 300 face each other in the second direction Y, and may not face the second subsidiary area SS2 and the third subsidiary area SS3 of the display panel 300. The second subsidiary area SS2 and the third subsidiary area SS3 of the display panel 300 face each other in the first direction X, and may not face the first subsidiary area SS1 and the fourth subsidiary area SS4 of the display panel 300.

The pad area PA may extend from the first side of the first subsidiary area SS1 of the display panel 300. The pad area PA may extend from the lower side of the first subsidiary area SS1 of the display panel 300. It is, however, to be understood that the present disclosure is not limited thereto. Alternatively, the pad area PA may extend from at least one selected from the second subsidiary area SS2, the third subsidiary area SS3 and the fourth subsidiary area SS4 of the display panel 300. Although not shown in the drawings, a bending portion may be further disposed between the first subsidiary area SS1 and the pad area PA of the display panel 300.

The display circuit board 310 may be attached to one side of the display panel 300. The display circuit board 310 may be attached on the pads disposed in the pad area PA using an anisotropic conductive film. The lead lines of the circuit board 310 may be electrically connected to pads disposed in the pad area PA. The display circuit board 310 may be a flexible printed circuit board that may be bent, a rigid printed circuit board that is rigid and not bendable, or a hybrid printed circuit board including a rigid printed circuit board and a flexible printed circuit board.

The display driving circuit 320 receives control signals, and supply voltages and outputs signals and voltages for driving the display panel 300 through the display circuit board 310. The display driving circuit 320 may be formed as an integrated circuit and attached on the display circuit board 310, but is not limited thereto. In one exemplary embodiment, for example, the display driving circuit 320 may be formed as an integrated circuit and may be attached on the display panel 300 by a chip-on-glass ("COG") manner, a chip-on-plastic ("COP") manner, or an ultrasonic bonding.

A touch driving circuit 330 may be disposed on the display circuit board 310. The touch driving circuit 330 may be implemented as an integrated circuit and may be attached to the upper surface of the display circuit board 310. The touch driving circuit 330 may be electrically connected to sensor electrodes of a sensor electrode layer of the display panel 300 through the display circuit board 310. The touch driving circuit 330 may apply touch driving signals to the driving electrodes among the sensor electrodes and may sense changes in the amount of the charged capacitances between the driving electrodes and the sensing electrodes through the sensing electrodes among the sensor electrodes. The touch driving circuit 330 may determine whether a user has touched or the presence of nearby object based on the sensed changes in the amount. A user's touch refers to that an object such as the user's finger or a pen is brought into contact with a surface of the display device 1 disposed on the touch sensing layer TSL. The user's near proximity refers to that an object such as the user's finger and a pen is hovering over a surface of the display device 1.

A sound driving circuit 340 may be disposed on the display circuit board 310. The sound driving circuit 340 receives sound data from the main processor 710. The sound driving circuit 340 generates sound driving voltages corresponding to the sound data and outputs the sound driving voltages to the sound generators 500 to be described later. The sound driving voltages may include a first sound driving voltage and a second sound driving voltage. The sound generators 500 may contract or expand according to the first sound driving voltage and the second sound driving voltage, and sound may be output by vibrating the display panel 300 with the sound generators 500. It is, however, to be understood that the present disclosure is not limited thereto. The sound driving circuit 340 may be connected to at least one selected from the connection films 810, 820, 830 and 840 (see FIG. 19) which connects the plurality of sound generators 500 to be described later, and may be disposed other than the display circuit board 310. A structure in which the sound driving circuit 340 is not disposed on the display circuit board 310 will be described later with reference to FIGS. 19 and 20.

The sound driving circuit 340 may include a digital signal processor ("DSP") for processing sound data that is a digital signal, a digital-to-analog converter ("DAC") for converting the digital data processed in the digital signal processor into sound driving voltages that is an analog signal, an amplifier ("AMP") for amplifying and outputting the sound driving voltages.

In an exemplary embodiment, a power supply circuit for supplying display driving voltages for driving the display driving circuit 320 may be disposed on the display circuit board 310. Accordingly, the display driving voltages for driving the display panel 300 and the sound driving voltages for driving the sound generators 500 may be generated and supplied from different circuits. Therefore, the display driving voltages for driving the display panel 300 may be effectively prevented from being affected by the sound driving voltages for driving the sound generators 500.

Although not shown in the drawings, a cover panel member may be further disposed under the display panel 300. The cover panel member may be attached to the lower surface of the display panel 300 through an adhesive member. In an exemplary embodiment, the adhesive member may be a pressure sensitive adhesive ("PSA"), for example.

The cover panel member may include at least one selected from a light-absorbing member for absorbing light incident from outside, a buffer member for absorbing external impact, and a heat dissipating member for efficiently discharging heat from the display panel 300.

The light-absorbing member may be disposed under the display panel 300. The light-absorbing member blocks the transmission of light to prevent the elements disposed thereunder from being seen from above the display panel 300, such as the display circuit board 310. The light-absorbing member may include a light-absorbing material such as a black pigment and a dye.

The buffer member may be disposed under the light-absorbing member. The buffer member absorbs an external impact to prevent the display panel 300 from being damaged. The buffer member may be made up of a single layer or multiple layers. In one exemplary embodiment, for example, the buffer member may include or be formed of a polymer resin such as polyurethane, polycarbonate, polypropylene and polyethylene, or may include or be formed of a material having elasticity such as a rubber and a sponge obtained by foaming a urethane-based material or an acrylic-based material. The buffer member may be a cushion layer.

The heat dissipating member may be disposed under the buffer member. The heat-dissipating member may include a first heat dissipation layer including graphite or carbon nanotubes, and a second heat dissipation layer including or formed of a thin metal film such as copper, nickel, ferrite and silver, which may block electromagnetic waves and have high thermal conductivity.

Referring to FIG. 4, the display circuit board 310 may be bent to be disposed under the display panel 300. The display circuit board 310 may be fixed or bonded to the lower surface of the display panel 300 or the cover panel member by a fixing member such as a screw or an adhesive member such as a PSA under the display panel 300.

A plurality of sound generators 500 may be disposed under the display panel 300 of the main area FS. The plurality of sound generators 500 may be disposed under the display panel 300 in the main region FS not to overlap the display circuit board 310 in the thickness direction (or Z-axis direction).

The plurality of sound generators 500 may include a first sound generator 510, a second sound generator 520, a third sound generator 530, and a fourth sound generator 540. The sound generators 510, 520, 530 and 540 are disposed on the subsidiary areas SS1, SS2, SS3 and SS4 of the display panel 300, respectively, under the main area FS of the display panel 300. Each of the second generators 500 may be a piezoelectric element or a piezoelectric actuator that vibrates the display panel 300 using a piezoelectric material that contracts or expands based on a voltage applied thereto.

Referring back to FIG. 2, the bracket 600 may be disposed under the display panel 300. The bracket 600 may include a plastic and/or a metal. In the bracket 600, a first camera hole CMH1, in which a camera device 720 is inserted, a battery hole BH in which a battery BT is disposed, and a cable hole CAH, through which a cable 314 connected to the display circuit board 310 is disposed, are defined.

The main circuit board 700 may be disposed under the bracket 600. The main circuit board 700 may be, but is not limited to, a printed circuit board or a flexible printed circuit board.

The main processor 710, the camera device 720 and a main connector 730 may be disposed on the main circuit board 700. The camera device 720 may be disposed on both the top and bottom surfaces of the main circuit board 700, the main processor 710 may be disposed on the top surface of the main circuit board 700, and the main connector 730 may be disposed on the bottom surface of the main circuit board 700.

The main processor 710 may control entire functions of the display device 1. In one exemplary embodiment, for example, the main processor 710 may output digital video data to the display driving circuit 320 through the display circuit board 310 so that the display panel 300 displays images. In an exemplary embodiment, the main processor 710 may receive sensor data from the touch driving circuit 330 and may determine whether there is the user's touch or a proximity touch to then perform an operation associated with the user's touch input or the proximity touch if so. In one exemplary embodiment, for example, the main processor 710 may run an application indicated by the icon touched by the user. In an exemplary embodiment, the main processor 710 may output the sound data to the sound driving circuit 340 for driving the sound generators 500 to output sound by vibrating the display panel 300 using the sound generators 500. The main processor 710 may be an application processor, a central processing unit, or a system chip implemented as an integrated circuit.

The camera device 720 processes image frames such as still image and video obtained by the image sensor in the camera mode and outputs the processed image frames to the main processor 710.

The cable 314 disposed through the cable hole CAH of the bracket 60 may be connected to main connector 730. Accordingly, the main circuit board 700 may be electrically connected to a connector 313 (shown in FIG. 7) of the display circuit board 310.

A first connection terminal provided at one end of the cable 314 disposed on the display circuit board 310 may be inserted into the insertion portion of a first connector. The second connection terminal disposed at the other end of the cable 314 may be bent below the main circuit board 700 through the cable hole CAH defined through the bracket 600, to be inserted into the main connector 730.

In an exemplary embodiment, a mobile communications module capable of transmitting/receiving a radio signal to/from a base station, an external terminal or a server over a mobile communications network may be further mounted on the main circuit board 700. The wireless signal may include various types of data based on a voice signal, a video call signal, or a text/multimedia message transmission/reception.

The bottom cover 900 may be disposed below the bracket 600 and the main circuit board 700. The bottom cover 900 may be fastened and fixed to the bracket 600. In one exemplary embodiment, for example, the bottom cover 900 may support the cover window 100, and the ends of the subsidiary areas SS1, SS2, SS3 and SS4 of the display panel 300 disposed in the first to fourth subsidiary display areas DA1 to DA4 of the display device 1, respectively. It is, however, to be understood that the present disclosure is not limited thereto. The bottom cover 900 may cover the cover window 100 and the subsidiary areas SS1, SS2, SS3 and SS4 and the main area FS of the display panel 300. The bottom cover 900 may be located in the non-display area NDA of the display device 1.

The bottom cover 900 may form or define the exterior of the lower surface of the display device 1. The bottom cover 900 may include a plastic and/or a metal. A second camera hole CMH2 may be defined or formed in the bottom cover 900 via which the lower surface of the camera device 720 is exposed. The positions of the camera device 720 and the first and second camera holes CMH1 and CMH2 in line with the camera device 720 are not limited to those shown in FIG. 2, but may be variously modified.

According to an exemplary embodiment, as shown in FIGS. 1 and 2, the sound may be output using the sound generators 500 that is not exposed to the outside by utilizing the display panel 300 as a vibrating surface. In such an embodiment, no portion of the front surface of the display device is removed for a call receiver that outputs a person's voice who a user is calling to, so that the transmissive portion 100DA of the cover window 100 may be widened. Therefore, the area where images are displayed by the display panel 300 may be widened.

Figure 5A:
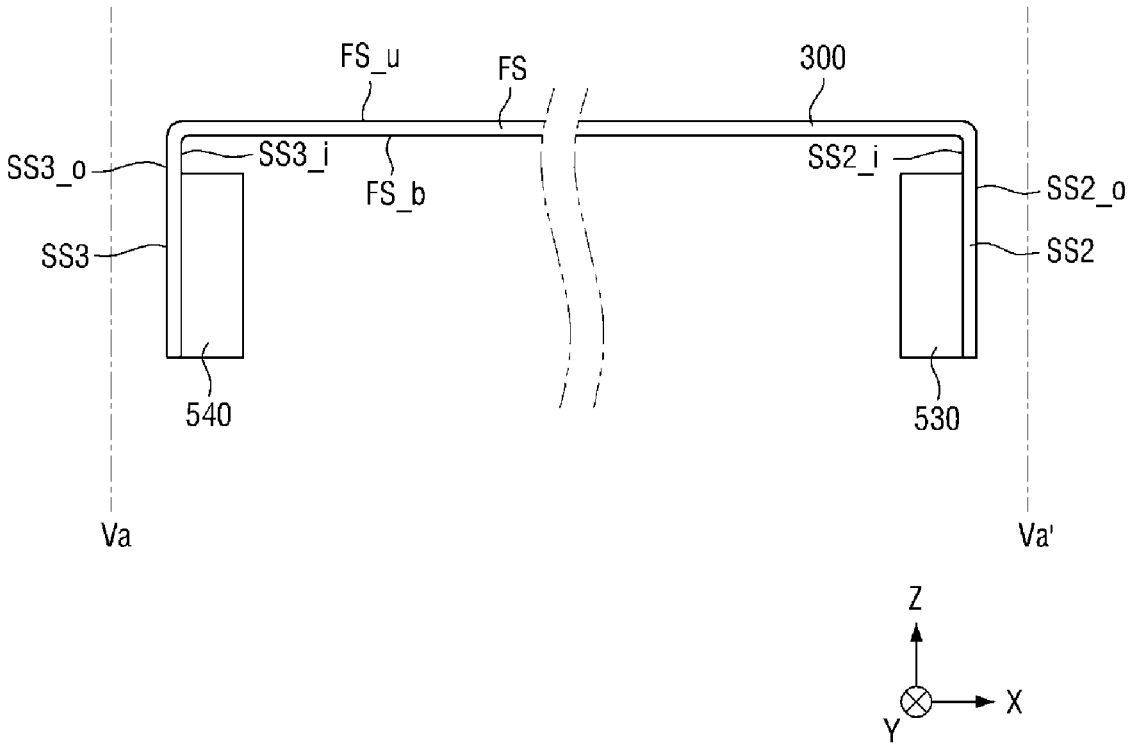
FIG. 5A is a cross-sectional view, taken along line Va-Va' of FIG. 4.
Figure 5B:
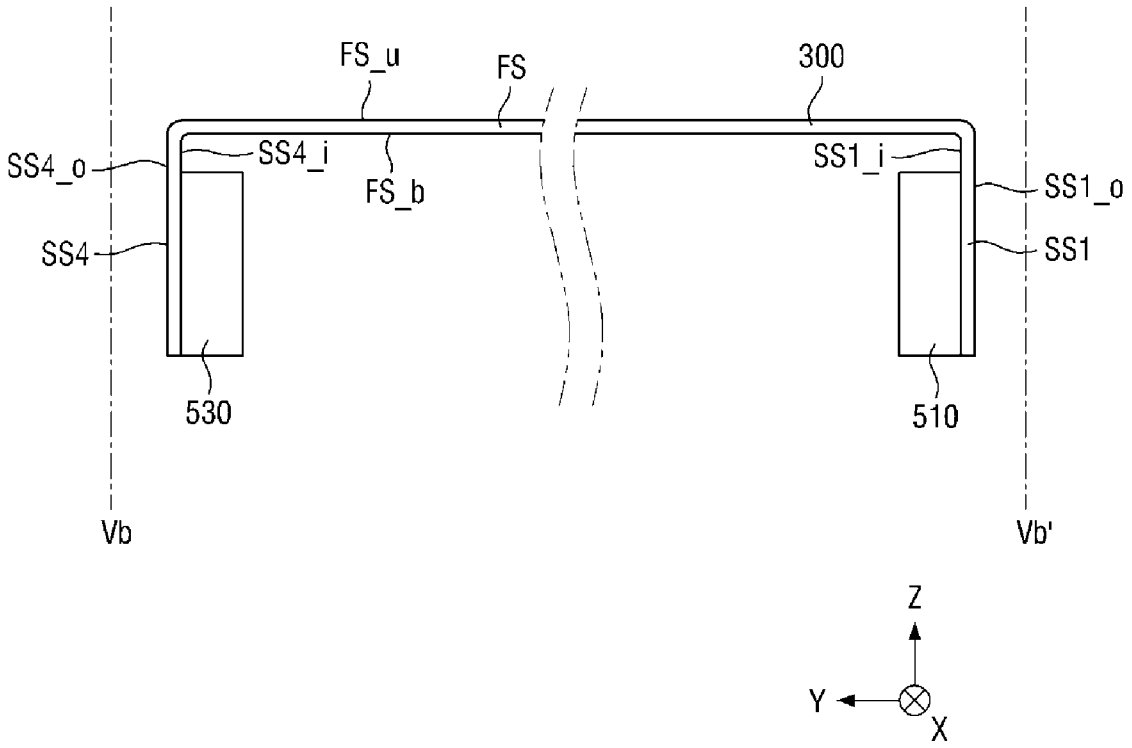
FIG. 5B is a cross-sectional view, taken along line Vb-Vb' of FIG. 4.
Figure 6:
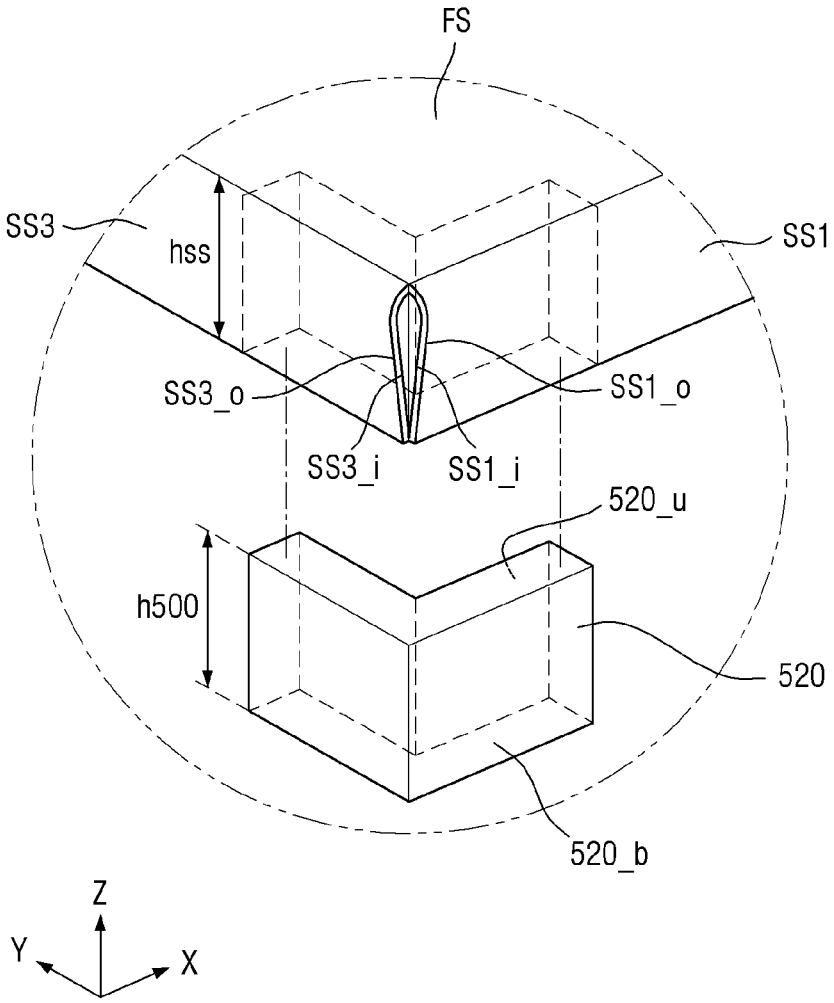
FIG. 6 is an enlarged exploded perspective view of portion Q of FIG. 4.

FIG. 5A is a cross-sectional view taken along line Va-Va' of FIG. 4. FIG. 5B is a cross-sectional view taken along line Vb-Vb' of FIG. 4. FIG. 6 is an enlarged exploded perspective view of portion Q of FIG. 4.

Referring to FIGS. 5A and 5B, the main area FS of the display panel 300 may include a top surface FS_u and a bottom surface FS_b, and each of the subsidiary areas SS1, SS2, SS3 and SS4 of the display panel may include an outer surface, an inner surface and side surfaces.

The main area FS of the display panel 300 may include the top surface FS_u and the bottom surface FS_b. The top surface FS_u of the main area FS of the display panel 300 may face the cover window 100, and the bottom surface FS_b of the main area FS of the display panel 300 may be a surface opposite to the top surface FS_u. The top surface FS_u of the main area FS of the display panel 300 may be disposed on a plane, and the bottom surface FS_b thereof may be disposed on another plane, such that the plane where the top surface FS_u of the main area FS is located is in parallel with the plane where the bottom surface FS_b of the main area FS is located, and accordingly the main area FS of the display panel 300 may have a constant or uniform thickness.

The first subsidiary area SS1 of the display panel 300 may include an outer surface SS1_*o*, an inner surface SS1_*i*, and side surfaces. The inner surface SS1_*i* of the first subsidiary area SS1 faces the fourth subsidiary area SS4, and the outer surface SS1_*o* of the first subsidiary area SS1 is opposite to the inner surface SS1_*i*. The outer surface SS1_*o* of the first subsidiary area SS1 of the display panel 300 may be a surface extending from the top surface FS_u of the main area FS of the display panel 300 and bent in the vertical direction, and the inner surface SS1_*i* of the first subsidiary area SS1 of the display panel 300 may be a surface extending from the bottom surface FS_b of the main area FS of the display panel 300 and bent in the vertical direction.

The second subsidiary area SS2 of the display panel 300 may include an outer surface SS2_*o*, an inner surface SS2_*i*, and side surfaces. The inner surface SS2_*i* of the second subsidiary area SS2 faces the third subsidiary area SS3, and the outer surface SS2_*o* of the second subsidiary area SS2 is opposite to the inner surface SS2_*i*. The outer surface SS2_*o* of the second subsidiary area SS2 of the display panel 300 may be a surface extending from the top surface FS_u of the main area FS of the display panel 300 and bent in the vertical direction, and the inner surface SS2_*i* of the second subsidiary area SS2 of the display panel 300 may be a surface extending from the bottom surface FS_b of the main area FS of the display panel 300 and bent in the vertical direction.

The third subsidiary area SS3 of the display panel 300 may include an outer surface SS3_*o*, an inner surface SS3_*i*, and side surfaces. The inner surface SS3_*i* of the third subsidiary area SS3 faces the second subsidiary area SS2, and the outer surface SS3_*o* of the third subsidiary area SS3 is opposite to the inner surface SS3_*i*. The outer surface SS3_*o* of the third subsidiary area SS3 of the display panel 300 may be a surface extending from the top surface FS_u of the main area FS of the display panel 300 and bent in the vertical direction, and the inner surface SS3_*i* of the third subsidiary area SS3 of the display panel 300 may be a surface extending from the bottom surface FS_b of the main area FS of the display panel 300 and bent in the vertical direction.

The fourth subsidiary area SS4 of the display panel 300 may include an outer surface SS4_*o*, an inner surface SS4_*i*, and side surfaces. The inner surface SS4_*i* of the fourth subsidiary area SS4 faces the first subsidiary area SS1, and the outer surface SS4_*o* of the fourth subsidiary area SS4 is opposite to the inner surface SS4_*i*. The outer surface SS4_*o* of the fourth subsidiary area SS4 of the display panel 300 may be a surface extending from the top surface FS_u of the main area FS of the display panel 300 and bent in the vertical direction, and the inner surface SS4_*i* of the fourth subsidiary area SS4 of the display panel 300 may be a surface extending from the bottom surface FS_b of the main area FS of the display panel 300 and bent in the vertical direction.

The inner surfaces SS1_*i* and SS4_*i* of the first subsidiary area SS1 and the fourth subsidiary area SS4 of the display panel 300 are located on an inner side between the first subsidiary area SS1 and the fourth subsidiary area SS4. The outer surfaces SS1_*o* and SS4_*o* of the first subsidiary area SS1 and the fourth subsidiary area SS4 are located on opposite sides. In such an embodiment, the inner surfaces SS2_*i* and SS3_*i* of the second subsidiary area SS2 and the third subsidiary area SS3 of the display panel 300 are located on an inner side between the second subsidiary area SS2 and the third subsidiary area SS3. The outer surfaces SS2_*o* and SS3_*o* of the second subsidiary area SS2 and the third subsidiary area SS3 are located on opposite sides. Hereinafter, the side where the inner surfaces SS1_*i*, SS2_*i*, SS3_*i* and SS4_*i* of the subsidiary areas SS1, SS2, SS3 and SS4 of the display panel 300 are located is defined as an inner side of the subsidiary areas SS of the display panel 300, and the side where the outer surfaces SS1_*o*, SS2_*o*, SS3_*o* and SS4_*o* of the subsidiary areas SS1, SS2, SS3 and SS4 of the display panel 300 are located is defined as an outer side of the subsidiary areas SS of the display panel 300.

The outer surfaces SS1_*o*, SS2_*o*, SS3_*o* and SS4_*o* and the inner surfaces SS1_*i*, SS2_*i*, SS3_*i* and SS4_*i* of the subsidiary areas SS1, SS2, SS3 and SS4 of the display panel 300 are disposed on different planes, respectively. Accordingly, the planes on which the outer surfaces SS1_*o*, SS2_*o*, SS3_*o* and SS4_*o* are located and the planes on which the inner surfaces SS1_*i*, SS2_*i*, SS3_*i* and SS4_*i* are located may be substantially parallel with each other, such that the thickness of the subsidiary areas SS1, SS2, SS3 and SS4 of the display panel 300 may be generally uniform. The outer surfaces SS1_*o*, SS2_*o*, SS3_*o* and SS4_*o* of the subsidiary areas SS1, SS2, SS3 and SS4 extending from the top surface FS_u of the main area FS of the display panel 300 and bent in the vertical direction, and the inner surfaces SS1_*i*, SS2_*i*, SS3_*i* and SS4_*i* of the subsidiary areas SS1, SS2, SS3 and SS4 extending from the lower surface FS_b of the main area FS of the display panel 300 and bent in the vertical direction may have a thickness substantially equal to the thickness of the main area FS of the display panel 300. In such an embodiment, the thickness direction of the main area FS of the display panel 300 may be identical to the thickness direction of the display device 1, i.e., the third direction Z, but the thickness direction of the first subsidiary area SS1 and the fourth subsidiary area SS4 of the display panel 300 may be the second direction Y while the thickness direction of the second subsidiary area SS2 and the third subsidiary area SS3 of the display panel 300 may be the first direction X.

Hereinafter, referring to FIGS. 4 to 5B, the arrangement of the main area FS, the subsidiary areas SS1, SS2, SS3 and SS4 and the sound generators 500 of the display panel 300 will be described in detail.

The sound generators 500 are disposed under the main area FS of the display panel 300 (or on the opposite side in the third direction Z). The sound generators 500 are disposed on the inner side of the subsidiary areas SS1, SS2, SS3 and SS4 of the display panel 300 under the main area FS of the display panel 300.

The first sound generator 510 may be disposed under the main area FS of the display panel 300 and on the inner side of the first subsidiary area SS1 and the second subsidiary area SS2 of the display panel 300. The first sound generator 510 may be disposed on the inner surface SS1_*i* of the first subsidiary area SS1 of the display panel 300 and the inner surface SS2_*i* of the second subsidiary area SS2. The first surface of the first sound generator 510 may face the inner surface SS1_*i* of the first subsidiary area SS1 and the inner surface SS2_*i* of the second subsidiary area SS2 of the display panel 300, and the second surface of the first sound generator 510 may be a surface opposite to the first surface thereof.

In an exemplary embodiment, the first surface of the first sound generator 510 may be fixed on the inner surface SS1_*i* of the first subsidiary area SS1 and the inner surface SS2_*i* of the second subsidiary area SS2 of the display panel 300 via an adhesive member. The adhesive member may be a PSA. In such an embodiment, where the first sound generator 510 is fixed on the first subsidiary area SS1 and the second subsidiary area SS2 of the display panel 300 by the PSA, the first subsidiary area SS1 and the second subsidiary area SS2 of the display panel 300 may be vibrated by the first sound generator 510 in the thickness direction (X-axis direction and/or Y-axis direction) of the first subsidiary area SS1 and the second subsidiary area SS2 of the display panel 300.

The second sound generator 520 may be disposed under the main area FS of the display panel 300 and on the inner side of the first subsidiary area SS1 and the third subsidiary area SS3 of the display panel 300. The second sound generator 520 may be disposed on the inner surface SS1_*i* of the first subsidiary area SS1 and the inner surface SS3_*i* of the third subsidiary area SS3 of the display panel 300. The first surface of the second sound generator 520 may face the inner surface SS1_*i* of the first subsidiary area SS1 and the inner surface SS3_*i* of the third subsidiary area SS3 of the display panel 300, and the second surface of the second sound generator 520 may be opposite to the first surface thereof.

In an exemplary embodiment, the first surface of the second sound generator 520 may be fixed on the inner surface SS1_*i* of the first subsidiary area SS1 and the inner surface SS3_*i* of the third subsidiary area SS3 of the display panel 300 via an adhesive member. The adhesive member may be a PSA. In such an embodiment, where the second sound generator 520 is fixed on the first subsidiary area SS1 and the third subsidiary area SS3 of the display panel 300 by the PSA, the first subsidiary area SS1 and the second subsidiary area SS2 of the display panel 300 may be vibrated by the second sound generator 510 in the thickness direction (X-axis direction and/or Y-axis direction) of the first subsidiary area SS1 and the third subsidiary area SS3 of the display panel 300.

The third sound generator 530 may be disposed under the main area FS of the display panel 300 and on the inner side of the second subsidiary area SS2 and the fourth subsidiary area SS4 of the display panel 300. The third sound generator 530 may be disposed on the inner surface SS2_*i* of the second subsidiary area SS2 and the inner surface SS4_*i* of the fourth subsidiary area SS4 of the display panel 300. The first surface of the third sound generator 530 may face the inner surface SS2_*i* of the second subsidiary area SS2 and the inner surface SS4_*i* of the fourth subsidiary area SS4 of the display panel 300, and the second surface of the third sound generator 530 may be opposite to the first surface thereof.

In an exemplary embodiment, the first surface of the third sound generator 530 may be fixed on the inner surface SS2_*i* of the second subsidiary area SS2 and the inner surface SS4_*i* of the fourth subsidiary area SS4 of the display panel 300 via an adhesive member. The adhesive member may be a PSA. In such an embodiment, where the third sound generator 530 is fixed on the second subsidiary area SS2 and the fourth subsidiary area SS4 of the display panel 300 by the PSA, the second subsidiary area SS2 and the fourth subsidiary area SS4 of the display panel 300 may be vibrated by the third sound generator 530 in the thickness direction (X-axis direction and/or Y-axis direction) of the second subsidiary area SS2 and the fourth subsidiary area SS4 of the display panel 300.

The fourth sound generator 540 may be disposed under the main area FS of the display panel 300 and on the inner side of the third subsidiary area SS3 and the fourth subsidiary area SS4 of the display panel 300. The fourth sound generator 540 may be disposed on the inner surface SS3_*i* of the third subsidiary area SS3 and the inner surface SS4_*i* of the fourth subsidiary area SS4 of the display panel 300. The first surface of the fourth sound generator 540 may face the inner surface SS3_*i* of the third subsidiary area SS3 and the inner surface SS4_*i* of the fourth subsidiary area SS4 of the display panel 300, and the second surface of the fourth sound generator 540 may be opposite to the first surface thereof.

In an exemplary embodiment, the first surface of the fourth sound generator 540 may be fixed on the inner surface SS3_*i* of the third subsidiary area SS3 and the inner surface SS4_*i* of the fourth subsidiary area SS4 of the display panel 300 via an adhesive member. The adhesive member may be a PSA. In such an embodiment, where the fourth sound generator 540 is fixed on the third subsidiary area SS3 and the fourth subsidiary area SS4 of the display panel 300 by the PSA, the third subsidiary area SS3 and the fourth subsidiary area SS4 of the display panel 300 may be vibrated by the fourth sound generator 540 in the thickness direction (X-axis direction and/or Y-axis direction) of the second subsidiary area SS2 and the fourth subsidiary area SS4 of the display panel 300.

In an exemplary embodiment, as shown in FIG. 4, the first sound generator 510 may be disposed at a first corner where the first subsidiary area SS1 and the second subsidiary area SS2 of the display panel 300 meet. In such an embodiment, the second sound generator 520 may be disposed at a second corner where the first subsidiary area SS1 and the third subsidiary area SS3 of the display panel 300 meet, the third sound generator 530 may be disposed at a third corner where the second subsidiary area SS2 and the fourth subsidiary area SS4 of the display panel 300 meet, and the fourth sound generator 540 may be disposed at a fourth corner where the third subsidiary area SS3 and the fourth subsidiary area SS4 of the display panel 300 meet.

Referring to FIGS. 4 and 6, the second sound generator 520 may be disposed at the second corner under the main area FS of the display panel 300. The second sound generator 520 may include a top surface 520_*u*, a bottom surface 520_*b*, and side surfaces (or first and second surfaces of the second sound generator 520). The top surface 520_*u* of the second sound generator 520 may be a surface facing the main area FS of the display panel 300, and the bottom surface 520_*b* of the second sound generator 520 may be a surface opposite to the top surface 520_*u*. The top surface 520_*u* of the second sound generator 520 may be located on a plane while the bottom surface 520_*b* thereof may be located on another plane. The plane where the top surface 520_u of the second sound generator 520 is located and the plane where the bottom surface 520_b is located may be generally parallel to each other, and the second sound generator 520 may have a constant or uniform height h500.

In an exemplary embodiment, the first subsidiary area SS1 and the third subsidiary area SS3 of the display panel 300 may extend from the main area FS of the display panel 300 and bent in the vertical direction, such that at least a part of the inner surface SS1_i of the first subsidiary area SS1 of the display panel 300 may meet at least a part of the inner surface SS3_i of the third subsidiary area SS3 of the display panel 300 at the second corner. In such an embodiment, the first subsidiary area SS1 of the display panel 300 and the third subsidiary area SS3 of the display panel 300 may be bent with a certain curvature in an area extending from the main area FS of the display panel 300. Therefore, the height hss of the third sub-region SS3 of the display panel 300 (the height from the side surface of the third subsidiary area SS3 of the display panel 300 to the main area FS of the display panel 300) may be smaller than the height at the position where the inner surface SS1_i of the first subsidiary area SS1 of the display panel 300 meets the inner surface SS3_i of the third subsidiary area SS3 of the display panel 300. The height h500 of the second sound generator 520 disposed on both the inner surface SS1_i of the first subsidiary area SS1 of the display panel 300 and the inner surface SS3_i of the third subsidiary area SS3 of the display panel 300 may be smaller than the height hss of the third subsidiary area SS3 of the display panel 300.

The relationship between the height h500 of the first sound generator 510, the third sound generator 530 and the fourth sound generator 540 and the height hss of the subsidiary areas SS of the display panel 300 where the sound generators 500 are disposed may be the same as or similar to the relationship between the second sound generator 520 and the height hss of the first subsidiary area SS1 of the display panel 300 and the third subsidiary area SS3 of the display panel 300. Since the relationship between the height h500 of the sound generators 500 and the height hss of the subsidiary areas SS of the display panel 300 are the same as or similar to the relationship between the height h500 of the second sound generator 520 and the height hss of the first subsidiary area SS1 and the third subsidiary area SS3 of the display panel 300, any repetitive detailed description thereof will be omitted for convenience of description.

Figure 7:
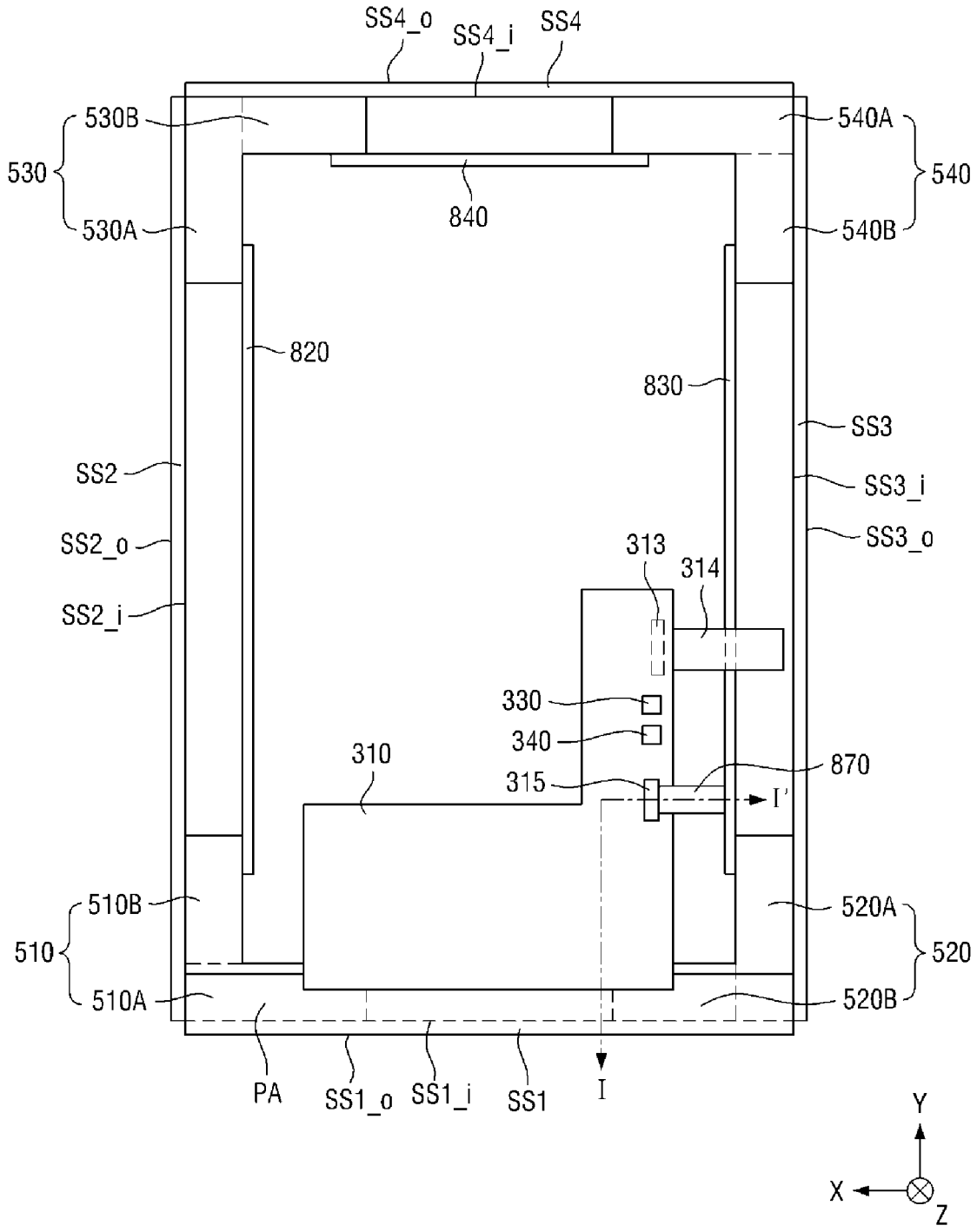
FIG. 7 is a bottom view showing an exemplary embodiment of the display panel, sound generators, connection films and the display circuit board attached to the cover window of FIG. 2.

FIG. 7 is a bottom view showing an exemplary embodiment of the display panel, sound generators, connection films and the display circuit board attached to the cover window of FIG. 2.

Referring to FIG. 7, in an exemplary embodiment, the first sound generator 510 may include a first first subsidiary sound generator 510A and a second first subsidiary sound generator 510B. In an exemplary embodiment, the first first subsidiary sound generator 510A and the second first subsidiary sound generator 510B may be connected to each other or integrally formed as a single unitary unit to define the first sound generator 510.

The first first subsidiary sound generator 510A may be disposed on the inner surface SS1_i of the first subsidiary area SS1 at the first corner and on the inner surface SS2_i of the second subsidiary area SS2 at the first corner of the display panel 300. The second first subsidiary sound generator 510B may be disposed on the inner surface SS2_i of the second subsidiary area SS2 at the first corner of the display panel 300.

The first first subsidiary sound generator 510A may have a rectangular shape having longer sides in the first direction X and shorter sides in the second direction Y when viewed from the top plan view. The longer sides of the first first subsidiary sound generator 510A may be disposed on the inner surface SS1_i of the first subsidiary area SS1 at the first corner of the display panel 300. The shorter sides of the first first subsidiary sound generator 510A may be disposed on the inner surface SS2_i of the second subsidiary area SS2 at the first corner of the display panel 300.

The second first subsidiary sound generator 510B may have a rectangular shape having longer sides in the second direction Y and shorter sides in the first direction X when viewed from the top plan view. The longer sides of the second first subsidiary sound generator 510B may be disposed on the inner surface SS2_i of the second subsidiary area SS2 at the first corner of the display panel 300.

The first direction X in which the longer sides of the first first subsidiary sound generator 510A extend may be perpendicular to the second direction Y in which the longer sides of the second first subsidiary sound generator 510B extend when viewed from the top plan view. In an exemplary embodiment, the second first subsidiary sound generator 510B may extend from the longer side direction (or first direction X) of the first first subsidiary sound generator 510A, may be bent in the direction perpendicular to the longer side direction X of the first first subsidiary sound generator 510A, i.e., in the second direction Y, and may be connected to the first first subsidiary sound generator 510A to define the first sound generator 510.

The second sound generator 520 may include a first second subsidiary sound generator 520A and a second second subsidiary sound generator 520B. The first second subsidiary sound generator 520A and the second second subsidiary sound generator 520B may be connected to each other or integrally formed as a single unitary unit to define the second sound generator 520.

The first second subsidiary sound generator 520A may be disposed on the inner surface SS3_i of the third subsidiary area SS3 at the second corner of the display panel and on the inner surface SS1_i of the first subsidiary area SS1 at the first corner of the display panel 300. The second second subsidiary sound generator 520B may be disposed on the inner surface SS1_i of the first subsidiary area SS1 at the second corner of the display panel 300.

The first second subsidiary sound generator 520A may have a rectangular shape having longer sides in the second direction Y and shorter sides in the first direction X when viewed from the top plan view. The longer sides of the first second subsidiary sound generator 520A may be disposed on the inner surface SS3i of the third subsidiary area SS3 at the second corner of the display panel 300. The shorter sides of the first second subsidiary sound generator 520A may be disposed on the inner surface SS1_i of the first subsidiary area SS1 at the second corner of the display panel 300.

The second second subsidiary sound generator 520B may have a rectangular shape having longer sides in the first direction X and shorter sides in the second direction Y when viewed from the top plan view. The longer sides of the second second subsidiary sound generator 520B may be disposed on the inner surface SS3_i of the third subsidiary area SS3 at the second corner of the display panel 300.

The second direction Y in which the longer sides of the first second subsidiary sound generator 520A extend may be perpendicular to the first direction X in which the longer sides of the second second subsidiary sound generator 520B extend when viewed from the top plan view. In an exemplary embodiment, the second second subsidiary sound generator 520B may extend from the longer side direction (or second direction Y) of the first second subsidiary sound generator 520A, may be bent in the direction perpendicular to the longer side direction Y of the first second subsidiary sound generator 520A, i.e., in the first direction X, and may be connected to the first second subsidiary sound generator 520A to define the second sound generator 520.

The third sound generator 530 may include a first third subsidiary sound generator 530A and a second third subsidiary sound generator 530B. The first third subsidiary sound generator 530A and the second third subsidiary sound generator 530B may be connected to each other or integrally formed as a single unitary unit to define the third sound generator 530.

The first third subsidiary sound generator 530A may be disposed on the inner surface SS4_*i* of the second subsidiary area SS3 at the third corner of the display panel and on the inner surface SS4_*i* of the fourth subsidiary area SS4 at the third corner of the display panel 300. The second third subsidiary sound generator 530B may be disposed on the inner surface SS4_*i* of the fourth subsidiary area SS4 at the third corner of the display panel 300.

The first third subsidiary sound generator 530A may have a rectangular shape having longer sides in the second direction Y and shorter sides in the first direction X when viewed from the top plan view. The longer sides of the first third subsidiary sound generator 530A may be disposed on the inner surface SS2_*i* of the second subsidiary area SS2 at the third corner of the display panel 300. The shorter sides of the first third subsidiary sound generator 530A may be disposed on the inner surface SS4_*i* of the fourth subsidiary area SS4 at the third corner of the display panel 300.

The second third subsidiary sound generator 530B may have a rectangular shape having longer sides in the first direction X and shorter sides in the second direction Y when viewed from the top plan view. The longer sides of the second third subsidiary sound generator 530B may be disposed on the inner surface SS4_*i* of the fourth subsidiary area SS4 at the third corner of the display panel 300.

The second direction Y in which the longer sides of the first third subsidiary sound generator 530A extend may be perpendicular to the first direction X in which the longer sides of the second third subsidiary sound generator 530B extend when viewed from the top plan view. In an exemplary embodiment, the second third subsidiary sound generator 530B may extend from the longer side direction (or second direction Y) of the first third subsidiary sound generator 530A, may be bent in the direction perpendicular to the longer side direction Y of the first third subsidiary sound generator 530A, i.e., in the first direction X, and may be connected to the first third subsidiary sound generator 530A to define the third sound generator 530.

The fourth sound generator 540 may include a first fourth subsidiary sound generator 540A and a second fourth subsidiary sound generator 540B. The first fourth subsidiary sound generator 540A and the second fourth subsidiary sound generator 540B may be connected to each other or integrally formed as a single unitary unit to define the fourth sound generator 540.

The first fourth subsidiary sound generator 540A may be disposed on the inner surface SS4_*i* of the fourth subsidiary area SS4 at the fourth corner of the display panel 300 and on the inner surface SS3_*i* of the third subsidiary area SS3 at the fourth corner of the display panel 300. The second fourth subsidiary sound generator 540B may be disposed on the inner surface SS3_*i* of the third subsidiary area SS3 at the fourth corner of the display panel 300.

The first fourth subsidiary sound generator 540A may have a rectangular shape having longer sides in the first direction X and shorter sides in the second direction Y when viewed from the top plan view. The longer sides of the first fourth subsidiary sound generator 540A may be disposed on the inner surface SS4_*i* of the fourth subsidiary area SS4 at the second corner of the display panel 300. The shorter sides of the first fourth subsidiary sound generator 540A may be disposed on the inner surface SS3_*i* of the third subsidiary area SS4 at the second corner of the display panel 300.

The second fourth subsidiary sound generator 540B may have a rectangular shape having longer sides in the second direction Y and shorter sides in the first direction X when viewed from the top plan view. The longer sides of the second fourth subsidiary sound generator 540B may be disposed on the inner surface SS3_*i* of the third subsidiary area SS3 at the fourth corner of the display panel 300.

The first direction X in which the longer sides of the first fourth subsidiary sound generator 540A extend may be perpendicular to the second direction Y in which the longer sides of the second fourth subsidiary sound generator 540B extend when viewed from the top plan view. In an exemplary embodiment, the second fourth subsidiary sound generator 540B may extend from the longer side direction (or first direction X) of the first fourth subsidiary sound generator 540A, may be bent in the direction perpendicular to the longer side direction X of the first fourth subsidiary sound generator 540A, i.e., in the second direction Y, and may be connected to the first fourth subsidiary sound generator 540A to define the fourth sound generator 540.

The display circuit board 310 may include a first base layer, lead lines disposed on a surface of the first base layer, and a first solder resist layer disposed on the lead lines. The first base layer may include or be made of a rigid or soft plastic. Among the lead lines, first lead lines refer to lead lines that are not connected to a sound connector 315, and second lead lines refer to lead lines that are connected to the sound connector 315. The first solder resist layer refers to an insulating layer for protecting the lead lines.

The sound connector 315 may be connected to at least one of the connection films 810, 820, 830 and 840 by a connection circuit film 870. The connection circuit film 870 and the connection films 810, 820, 830 and 840 may be implemented as flexible printed circuit ("FPC"). Each of the FPCs forming the connection circuit film 870 and the connection films 810, 820, 830 and 840 may include a first driving line and a second driving line.

The sound connector 315 may be disposed on the first base layer of the display circuit board 310 and may be connected to second lead lines among the lead lines. The sound connector 315 may be connected to the sound driving circuit 340 through the second lead lines. The sound driving voltage of the sound driving circuit 340 may include a first driving voltage and a second driving voltage, and the first driving voltage of the sound driving circuit 340 may be applied to the first electrode pads of the sound generators 500 through one of the second lead lines of the display circuit board 310, the sound connector 315, the first driving line of the connection circuit film 870 and the first driving lines of the connection films 810, 820, 830 and 840. In such an embodiment, the second driving voltage of the sound driving circuit 340 may be applied to second pads of the sound generators 500 through another one of the second lead lines of the display circuit board 310, the sound connector 315, the second driving line of the connection circuit film 870 and the second driving lines of the connection films 810, 820, 830 and 840.

The sound connector 315, the connection circuit film 870 and the connection films 810, 820, 830 and 840 will be described in greater detail later with reference to FIG. 10.

Figure 8:
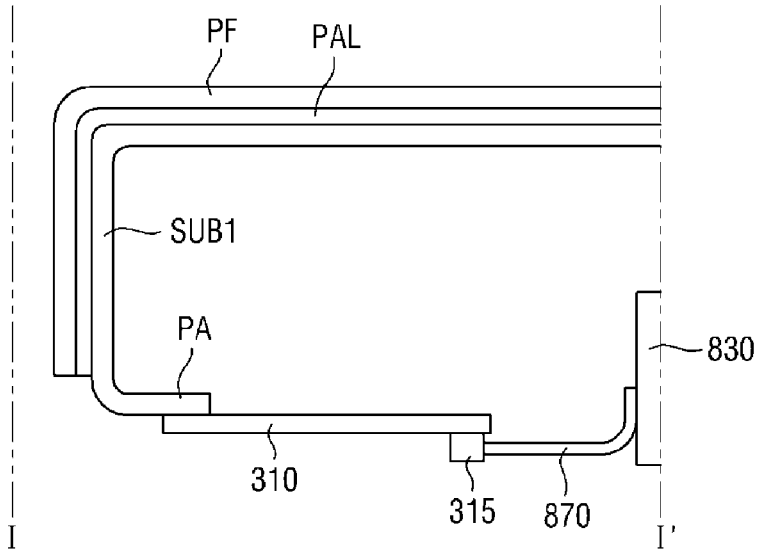
FIG. 8 is a cross-sectional view taken along line I-I' of FIG. 7.

FIG. 8 is a cross-sectional view taken along line I-I' of FIG. 7.

Referring to FIG. 8, the display panel 300 may include a substrate SUB1, a pixel array layer PAL, and a polarizing film PF.

The substrate SUB1 may be a rigid substrate or a flexible substrate that is bendable, foldable, or rollable, for example. In an exemplary embodiment, the substrate SUB1 may include or be made of an insulating material such as a glass, quartz and a polymer resin. The polymer material may include at least one material selected from polyethersulphone ("PES"), polyacrylate ("PA"), polyacrylate ("PAR"), polyetherimide ("PEI"), polyethylenenapthalate ("PEN"), polyethyleneterepthalate ("PET"), polyphenylenesulfide ("PPS"), polyallylate, polyimide ("PI"), polycarbonate ("PC"), cellulosetriacetate ("CAT"), cellulose acetate propionate ("CAP"), and a combination thereof. The substrate SUB1 may include a metal material.

The pixel array layer PAL may be disposed on the substrate SUB1. The pixel array layer PAL may include pixels PX to display an image. The pixel array layer PAL may include a thin-film transistor layer 303, an emission material layer 304 and a thin-film encapsulation layer 305 as shown in FIG. 9.

The polarizing film PF may be disposed on the pixel array layer PAL to prevent a decrease in visibility due to reflection of external light. The polarizing film may include a linear polarizer and a retardation film such as a $\lambda/4$ (quarter-wave) plate. In one exemplary embodiment, for example, the retardation film may be disposed on the pixel array layer PAL, and the linear polarizer may be disposed between the retardation film and the cover window 100.

Figure 9:
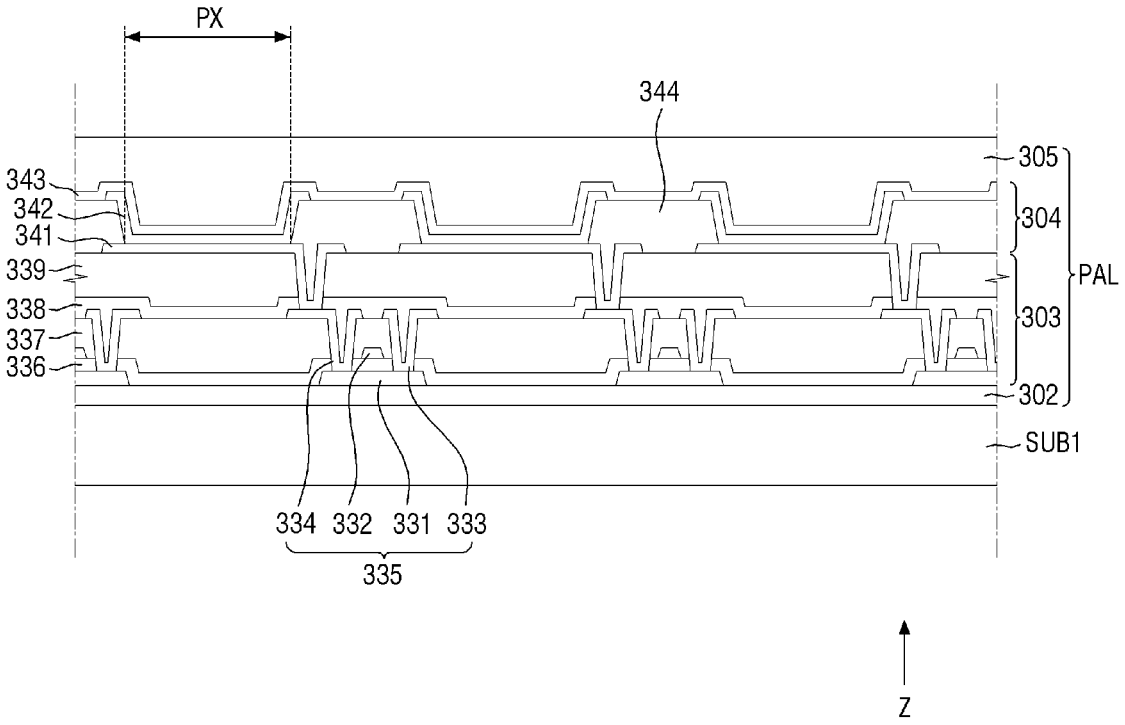
FIG. 9 is a cross-sectional view showing the display area of the display panel of FIG. 8 in detail.

FIG. 9 is a cross-sectional view showing the display area of the display panel of FIG. 8 in detail.

Referring to FIG. 9, the pixel array layer PAL may include a thin-film transistor layer 303, an emission material layer 304 and a thin-film encapsulation layer 305.

A buffer layer 302 may be disposed on the substrate SUB1. The buffer layer 302 may be disposed on the substrate SUB1 to protect the thin-film transistors 335 and the light-emitting elements from moisture permeating through the substrate SUB1 that is susceptible to moisture permeation. The buffer layer 302 may include or be formed of a plurality of inorganic layers stacked on one another alternately. In one exemplary embodiment, for example, the buffer layer 302 may include or be made up of multiple layers in which one or more inorganic layer of a silicon oxide layer (SiOx), a silicon nitride layer (SiNx) and SiON are stacked on one another alternately. Alternatively, the buffer layer may be omitted.

The thin-film transistor layer 303 is disposed on the buffer layer 302. The thin-film transistor layer 303 includes thin-film transistors 335, a gate insulating layer 336, an interlayer dielectric layer 337, a protective layer 338, and a planarization layer 339.

Each of the thin-film transistor 335 includes an active layer 331, a gate electrode 332, a source electrode 333, and a drain electrode 334. In an exemplary embodiment, as shown in FIG. 9, the thin-film transistors 335 may be top-gate transistors in which the gate electrode 332 is located above the active layer 331. It is, however, to be understood that the disclosure is not limited thereto. Alternatively, the thin-film transistors 335 may be bottom-gate transistors in which the gate electrode 332 is located below the active layer 331, or double-gate transistors in which the gate electrodes 332 are disposed above and below the active layer 331.

The active layer 331 is disposed on the buffer layer 302. The active layer 331 may include or be formed of a silicon-based semiconductor material or an oxide-based semiconductor material. In one exemplary embodiment, for example, the active layer 331 may include or be formed of a poly silicon, an amorphous silicon, or an oxide semiconductor. A light-blocking layer for blocking external light incident on the active layer 331 may be disposed between the buffer layer 302 and the active layer 331.

The gate insulating layer 336 may be disposed on the active layer 331. The gate insulating layer 336 may include or be formed of an inorganic layer, for example, a silicon oxide layer (SiOx), a silicon nitride layer (SiNx), or a multilayer thereof.

The gate electrodes 332 and gate lines may be disposed on the gate insulating layer 336. The gate electrodes 332 and the gate lines may include or be made up of a single layer or multiple layers of one of molybdenum (Mo), aluminum (Al), chromium (Cr), gold (Au), titanium (Ti), nickel (Ni), neodymium (Nd) and copper (Cu) or an alloy thereof.

The interlayer dielectric layer 337 may be disposed over the gate electrodes 332 and the gate lines. The interlayer dielectric layer 337 may include or be formed of an inorganic layer, for example, a silicon oxide layer (SiOx), a silicon nitride layer (SiNx), or a multilayer thereof.

The source electrode 333, the drain electrode 334 and a data line may be disposed on the interlayer dielectric layer 337. Each of the source electrodes 333 and the drain electrodes 334 may be connected to the active layer 331 through a contact hole defined through the gate insulating layer 336 and the interlayer dielectric layer 337. The source electrode 333, the drain electrode and the data line may include or be made up of a single layer or multiple layers of one of molybdenum (Mo), aluminum (Al), chromium (Cr), gold (Au), titanium (Ti), nickel (Ni), neodymium (Nd) and copper (Cu) or an alloy thereof.

The protective layer 338 may be disposed on the source electrode 333, the drain electrode 334 and the data line to insulate the thin-film transistors 335. The protective layer 338 may include or be formed of an inorganic layer, e.g., a silicon oxide layer (SiOx), a silicon nitride layer (SiNx), or a multilayer thereof.

The planarization layer 339 may be disposed on the protective layer 338 to provide a flat surface over the step differences of the thin-film transistors 335. The planarization layer 339 may include or be formed of an organic layer such as an acryl resin, an epoxy resin, a phenolic resin, a polyamide resin and a polyimide resin.

The emission material layer 304 is disposed above the thin-film transistors 335. The emission material layer 304 includes the light-emitting elements and a pixel-defining layer 344.

The light-emitting elements and the pixel-defining layer 344 are disposed on the planarization layer 339. The light-emitting elements may include an organic light-emitting device including an anode electrode 341, emissive layers 342 and a cathode electrode 343, for example.

The anode electrode 341 may be disposed on the planarization layer 339. The anode electrode 341 may be connected to the source electrode 333 of the thin-film transistor 335 via a contact hole defined through the protective layer 338 and the planarization layer 339.

The pixel-defining layer 344 may cover the edge of the anode electrode 341 on the planarization layer 339 to separate the pixels from one another. In such an embodiment, the pixel-defining layer 344 serves to define the pixels. In each of the pixels, the anode electrode 341, the emissive layer 342 and the cathode electrode 343 are sequentially stacked on one another so that holes from the anode electrode 341 and electrons from the cathode electrode 343 combine in the emissive layer 342 to emit light.

The emissive layers 342 are disposed on the anode electrode 341 and the pixel-defining layer 344. The emissive layers 342 may be organic emissive layers. The emissive layer 342 may emit one of red light, green light, and blue light. Alternatively, the emissive layer 342 may be a white emissive layer that emits white light. In such an embodiment, the red emissive layer, the green emissive layer and the blue emissive layer may be stacked on one another or may be disposed commonly across the pixels as a common layer. In such an embodiment, the display panel 300 may further include additional color filters for representing red, green and blue colors.

The emissive layer 342 may include a hole transporting layer, a light-emitting layer, and an electron transporting layer. In addition, the emissive layer 342 may be in a tandem structure of two or more stacks, in which a charge generating layer may be formed between the stacks.

The cathode electrode 343 is disposed on the emissive layer 342. The cathode electrode 343 may be disposed to cover the emissive layer 342. The cathode electrode 343 may be a common layer disposed across the pixels.

In an exemplary embodiment, where the emission material layer 304 is of a top-emission type in which light exits toward the top side, the anode electrode 341 may be made of a metal material having a high reflectivity such as a stack structure of aluminum and titanium (Ti/Al/Ti), a stack structure of aluminum and indium tin oxide ("ITO") (ITO/Al/ITO), an APC alloy and a stack structure of APC alloy and ITO (ITO/APC/ITO). The APC alloy is an alloy of silver (Ag), palladium (Pd) and copper (Cu). The cathode electrode 343 may be formed of a transparent conductive material ("TCP") such as ITO and indium zinc oxide ("IZO") that can transmit light, or a semi-transmissive conductive material such as magnesium (Mg), silver (Ag) and an alloy of magnesium (Mg) and silver (Ag). In an exemplary embodiment, the cathode electrode 343 may include or be formed of a semi-transmissive conductive material, such that the light extraction efficiency may be increased by microcavity effects.

In an exemplary embodiment, where the emission material layer 304 is of a bottom-emission type in which light exits toward the bottom side, the anode electrode 341 may include or be formed of a TCP such as ITO and IZO that can transmit light, or a semi-transmissive conductive material such as magnesium (Mg), silver (Ag) and an alloy of magnesium (Mg) and silver (Ag). In such an embodiment, the cathode electrode 343 may include or be made of a metal material having a high reflectivity such as a stack structure of aluminum and titanium (Ti/Al/Ti), a stack structure of aluminum and ITO (ITO/Al/ITO), an APC alloy and a stack structure of APC alloy and ITO (ITO/APC/ITO). In an exemplary embodiment, the anode electrode 341 may include or be formed of a semi-transmissive conductive material, such that the light extraction efficiency may be increased by microcavity effects.

The thin-film encapsulation layer 305 is disposed on the emission material layer 304. The thin-film encapsulation layer 305 serves to prevent permeation of oxygen or moisture into the emissive layer 342 and the cathode electrode 343. In such an embodiment, the thin-film encapsulation layer 305 may include at least one inorganic layer. The inorganic layer may include or be formed of at least one material selected from silicon nitride, aluminum nitride, zirconium nitride, titanium nitride, hafnium nitride, tantalum nitride, silicon oxide, aluminum oxide, and titanium oxide. In an exemplary embodiment, the thin-film encapsulation layer 305 may further include at least one organic layer. The organic layer may have a sufficient thickness to prevent particles from permeating into the thin-film encapsulation layer 305 to enter the emissive layer 342 and the cathode electrode 343. The organic layer may include at least one material selected from epoxy, acrylate and urethane acrylate.

The sensor electrode layer may be disposed on the thin-film encapsulation layer 305. In an exemplary embodiment, the sensor electrode layer is disposed directly on the thin-film encapsulation layer 305, such that the thickness of the display device 1 may be reduced, compared with a display device in which a separate touch panel is attached on the thin-film encapsulation layer 305.

The sensor electrode layer may include sensor electrodes for sensing a user's touch by capacitive sensing, and sensor lines for connecting the pads with the sensor electrodes. In one exemplary embodiment, for example, the sensor electrode layer can sense a user's touch or the presence of nearby object by self-capacitance sensing or mutual capacitance sensing.

Figure 10:
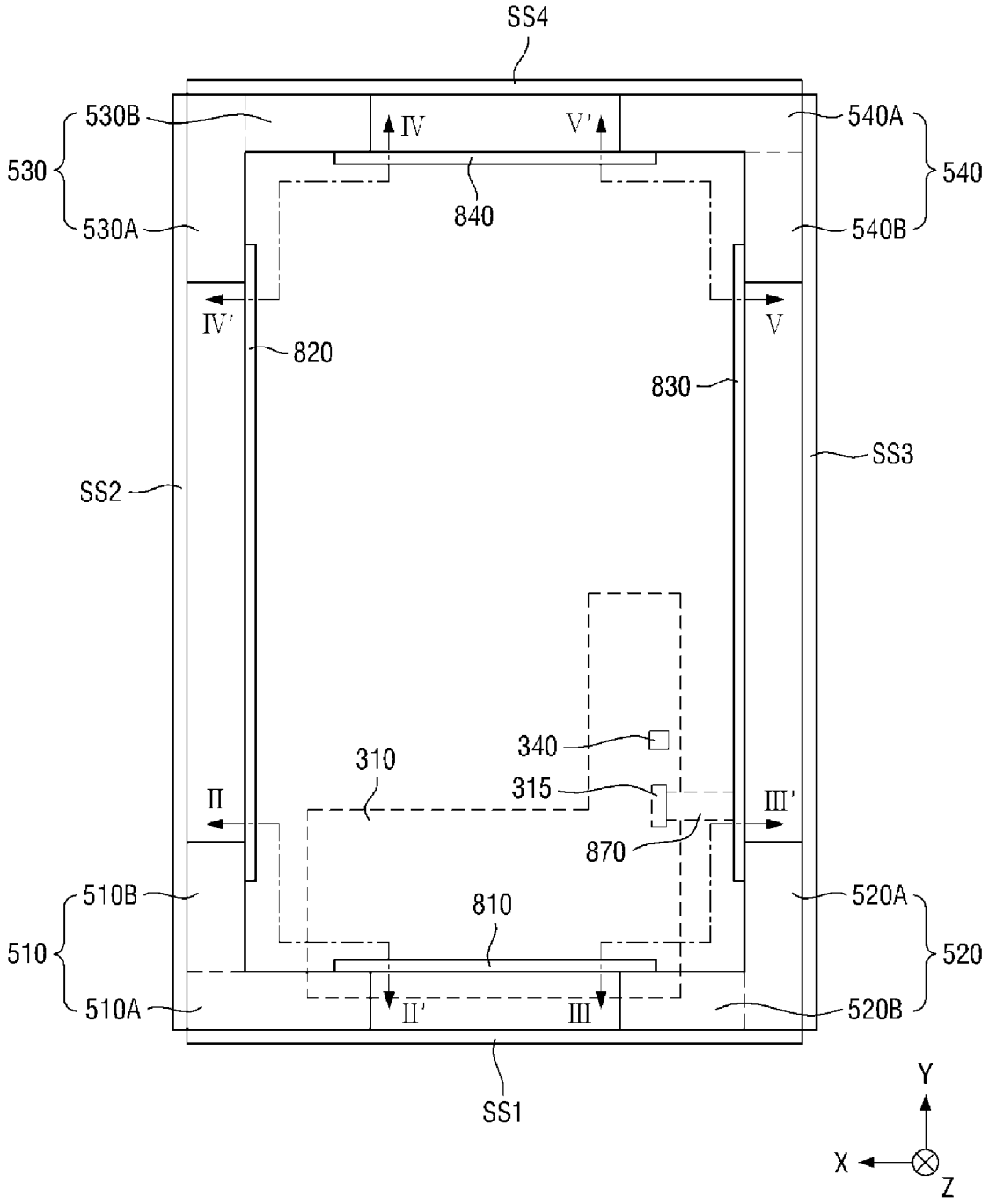
FIG. 10 is a bottom view schematically showing an arrangement of the display panel, the sound generating device, and the connecting film of FIG. 7.
Figure 13:
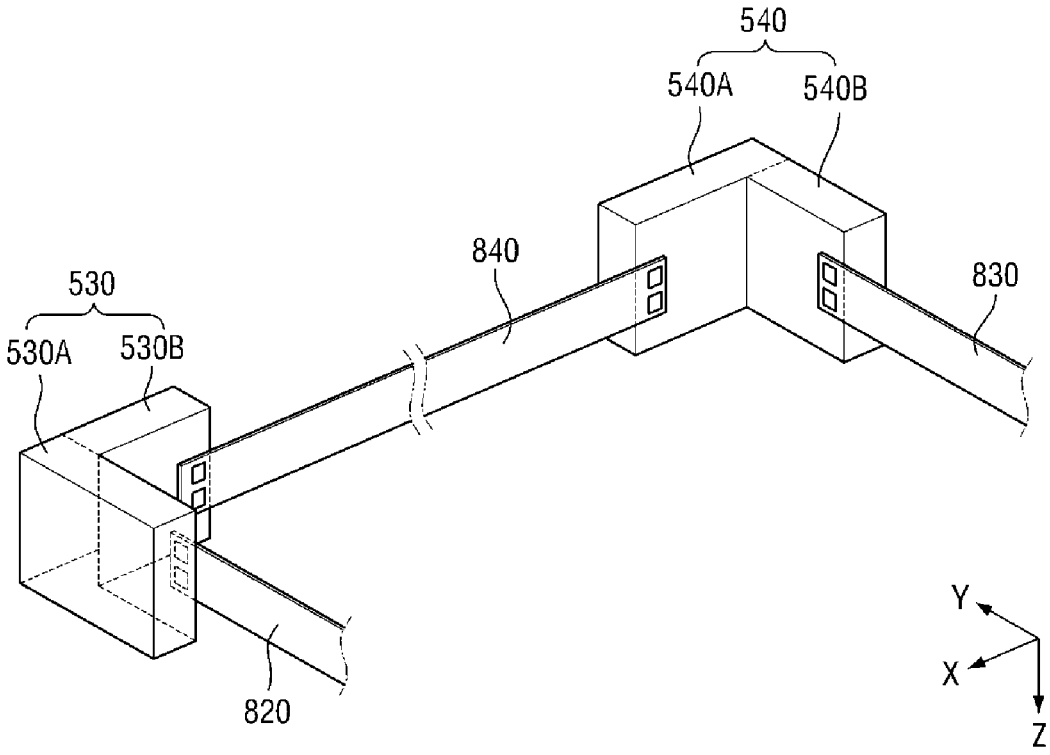
FIG. 13 is an enlarged perspective view showing a connection relationship between two sound generators of FIG. 10.

FIG. 10 is a bottom view schematically showing an arrangement of the display panel, the sound generator, and the connection film of FIG. 7. FIG. 13 is an enlarged perspective view showing a connection relationship between two sound generators of FIG. 10.

Hereinafter, referring to FIGS. 10 and 13, the arrangement of the plurality of sound generators 500 disposed on the display panel 300 and the connection relationship between the sound generators 510, 520, 530 and 540 will be described in detail.

Referring to FIGS. 10 and 13, the sound generators 510, 520, 530 and 540 are spaced apart from one another on the subsidiary areas SS of the display panel 300.

In an exemplary embodiment, the first first subsidiary sound generator 510A and the second second subsidiary sound generator 520B may be spaced apart from each other on the inner surface SS1_*i* of the first subsidiary area SS1. In such an embodiment, the first sound generator 510 and the second sound generator 520 may be spaced apart from each other in the first direction X. In an exemplary embodiment, the second first subsidiary sound generator 510B and the first third subsidiary sound generator 530A may be spaced apart from each other on the inner surface SS2_*i* of the second subsidiary area SS2. In such an embodiment, the first sound generator 510 and the third sound generator 530 may be spaced apart from each other in the second direction Y. In an exemplary embodiment, the first second subsidiary sound generator 520A and the second fourth subsidiary sound generator 540B may be spaced apart from each other on the inner surface SS3_*i* of the third subsidiary area SS3. In such an embodiment, the second sound generator 520 and the fourth sound generator 540 may be spaced apart from each other in the second direction Y. In an exemplary embodiment, the first fourth subsidiary sound generator 540A and the second third subsidiary sound generator 530B may be spaced apart from each other on the inner surface SS4_*i* of the fourth subsidiary area SS4. In such an embodiment, the third sound generator 530 and the fourth sound generator 540 may be spaced apart from each other in the first direction X.

On the second surface of each of the sound generators 510, 520, 530 and 540, a first electrode pad and a second electrode pad may be exposed without being covered by a protective layer disposed on the outer side of the sound generators 510, 520, 530 and 540. The sound generators 510, 520, 530 and 540 may be connected with one another through the connection films 810, 820, 830 and 840. The connection films 810, 820, 830 and 840 may be disposed on the second surfaces of the sound generators 510, 520, 530 and 540, respectively.

In an exemplary embodiment, the first sound generator 510 and the second sound generator 520 may be connected to each other through the first connection film 810. The first connection film 810 may be disposed on the second surfaces of the first sound generator 510 and the second sound generator 520 and may extend in the first direction X. One side of the first connection film 810 may be disposed on the second surface of the first first subsidiary sound generator 510A, and another side of the first connection film 810 may be disposed on the second surface of the second second subsidiary sound generator 520B.

The first sound generator 510 and the third sound generator 530 may be connected to each other through the second connection film 820. The second connection film 820 may be disposed on the second surfaces of the first sound generator 510 and the third sound generator 530 and may extend in the second direction Y. One side of the second connection film 820 may be disposed on the second surface of the second first subsidiary sound generator 510B, and another side of the second connection film 820 may be disposed on the second surface of the first third subsidiary sound generator 530A.

The second sound generator 520 and the fourth sound generator 540 may be connected to each other through the third connection film 830. The third connection film 830 may be disposed on the second surfaces of the second sound generator 520 and the fourth sound generator 540 and may extend in the second direction Y. One side of the third connection film 830 may be disposed on the second surface of the first second subsidiary sound generator 520A, and another side of the third connection film 830 may be disposed on the second surface of the second fourth subsidiary sound generator 540B.

The third sound generator 530 and the fourth sound generator 540 may be connected to each other through the fourth connection film 840. The fourth connection film 840 may be disposed on the second surfaces of the third sound generator 530 and the fourth sound generator 540 and may extend in the first direction X. One side of the fourth connection film 840 may be disposed on the second surface of the second third subsidiary sound generator 530B, and another side of the fourth connection film 840 may be disposed on the second surface of the first fourth subsidiary sound generator 540A.

In one exemplary embodiment, for example, referring to FIG. 13, the fourth connection film 840 may include a second base layer, a first driving line, a second driving line, and a second solder resist layer. The second base layer of the fourth connection film 840 may include or be made of a rigid or flexible plastic. The first driving line and the second driving line may be disposed on the second base layer. The second solder resist layer may be disposed on the first driving line and the second driving line. The second solder resist layer may be an insulating layer for protecting the first driving line and the second driving line.

One end of the first driving line of the fourth connection film 840 may be electrically connected to a first fourth subsidiary first electrode pad exposed on the second surface of the first fourth subsidiary sound generator 540A, and another end of the first driving line of the fourth connection film 840 opposite to the one end may be electrically connected to a second third subsidiary first electrode pad exposed on the second surface of the second third subsidiary sound generator 530B. An anisotropic conductive adhesive member may be further disposed between the first driving line and the first fourth subsidiary first electrode pad and between the first driving line and the second third subsidiary first electrode pad of the fourth connection film 840.

One end of the second driving line of the fourth connection film 840 may be electrically connected to a first fourth subsidiary second electrode pad exposed on the second surface of the first fourth subsidiary sound generator 540A, and another end of the second driving line of the fourth connection film 840 opposite to the one end may be electrically connected to a second third subsidiary second electrode pad exposed on the second surface of the second third subsidiary sound generator 530B. An anisotropic conductive adhesive member may be further disposed between the second driving line and the first fourth subsidiary second electrode pad and between the second driving line and the second third subsidiary second electrode pad of the fourth connection film 840.

As similarly to the third connection film 830, the first connection film 810, the second connection film 820 and the fourth connection film 840 may electrically connect the sound generators 500.

The first electrode pads and the second electrode pads exposed on the second surfaces of the sound generators 510, 520, 530 and 540 are electrically connected to the first driving lines and the second driving lines of the connection films 810, 820, 830 and 840, such that a sound driving voltage of a single sound driving circuit 340 may be applied to the first electrode pads and the second electrode pads of the sound generators 510, 520, 530 and 540 through the first driving line and the second driving line of at least one connection film among the connection films 810, 820, 830 and 840, thereby driving all of the sound generators 510, 520, 530 and 540 altogether. As a result, the plurality of sound generators 510, 520, 530 and 540 may be driven altogether by the single sound driving circuit 340, to provide the space where the sound driving circuit 340 is allowed to be disposed within the display device 1.

Referring back to FIG. 10, the sound generators 510, 520, 530 and 540 may be connected to the sound connector by the connection circuit film and the connection films 810, 820, 830 and 840. According to an exemplary embodiment of the disclosure, the second sound generator 520 and the fourth sound generator 540 are electrically connected by the third connection film 830, and the third connection film 830 is connected to one end of the connection circuit film 870. The opposite end of the connection circuit film 870 may be connected to the sound connector 315 so that the second sound generator 520 and the fourth sound generator 540 may be electrically connected to the sound connector 315 by the connection circuit film 870 and the third connection film 830. As described above, since the plurality of sound generators 510, 520, 530 and 540 are electrically connected with one another through the connection films, the first sound generator 510 and the third sound generator 530 may be connected the second sound generator 520 and the fourth sound generator 540 through the connection film, and may be electrically connected to the sound connector 315.

The connection circuit film 870 may include a first driving line and a second driving line. The first driving line and the second driving line disposed at one end of the connection circuit film 870 may be electrically connected to the first driving line and the second driving line of the third connection film 830, respectively. The opposite end of the connection circuit film 870 may be connected to the sound connector 315.

The sound connector 315 electrically connects the second lead lines of the display circuit board 310 with the connection circuit film 870. The sound connector 315 may be implemented with a sound connector or a sound circuit film. The sound connector 315 may be connected to the sound driving circuit 340 through the second lead lines of the display circuit board 310. The first driving voltage of the sound driving circuit 340 may be applied to the first electrode pad of the sound generators 500 via one of the second lead lines of the display circuit board 310, the sound connector 315, the first driving line of the connection circuit film 870, and the connection film 830. In addition, the second driving voltage of the sound driving circuit 340 may be applied to the second electrode pad of the sound generator 510 via another one of the second lead lines of the display circuit board 310, the sound connector 315, the second driving line of the connection circuit film 870, and the connection film 830.

Figure 11:
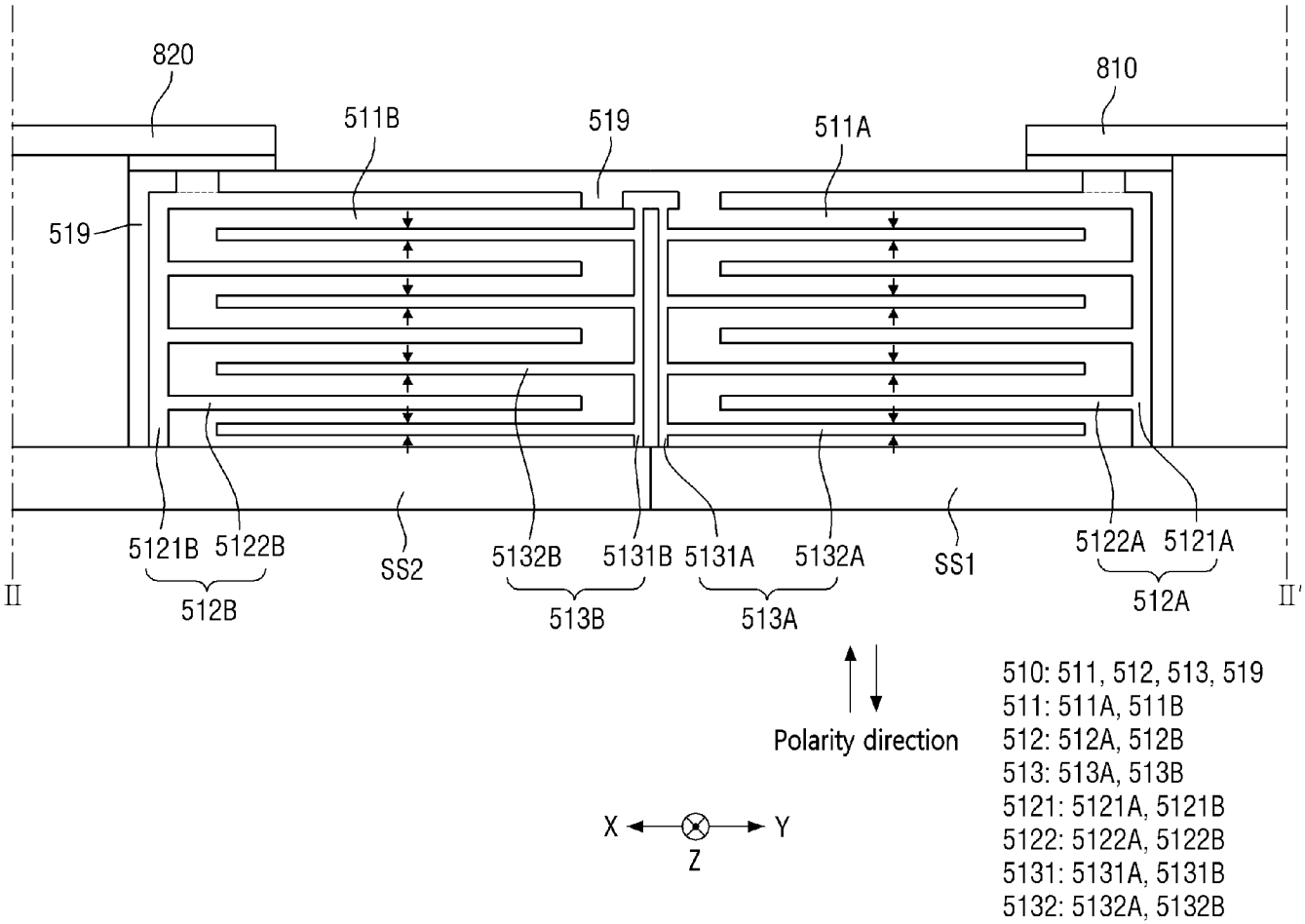
FIG. 11 is a cross-sectional view showing an exemplary embodiment of the first sound generator, taken along line II-II' of FIG. 10.
Figure 12:
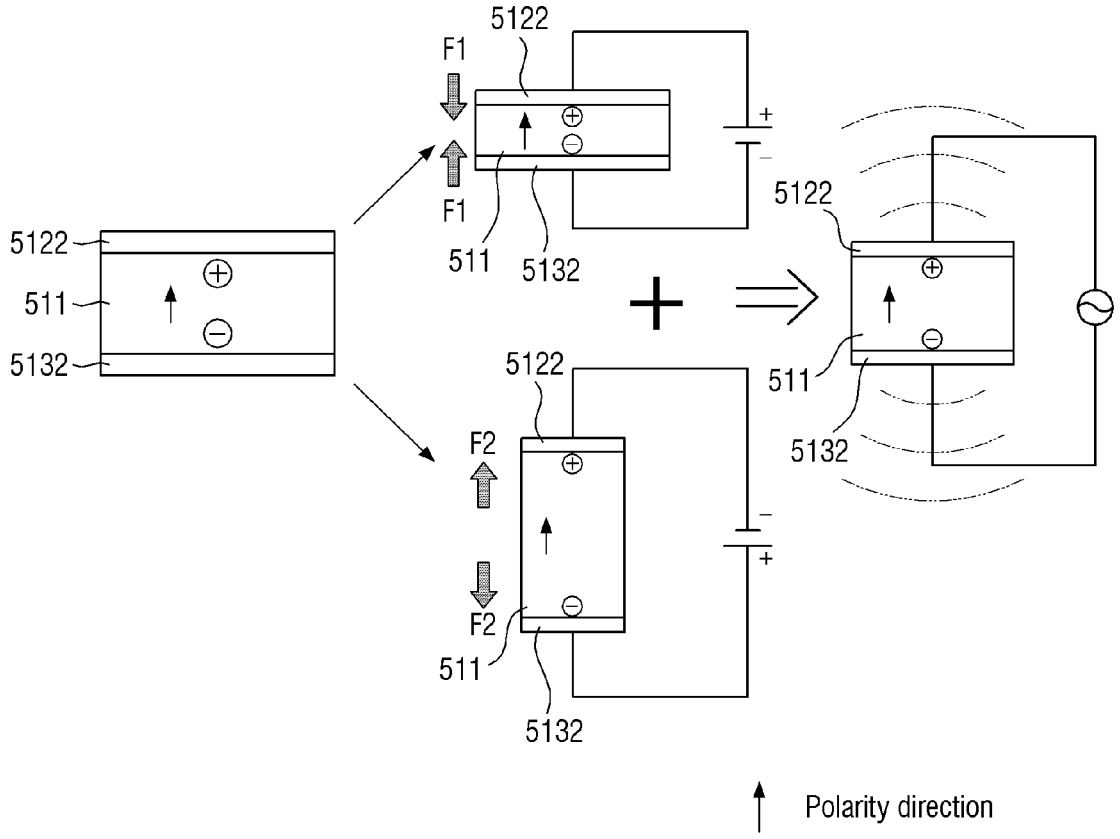
FIG. 12 is a view showing an exemplary way of vibrating a vibration layer disposed between a first branch electrode and a second branch electrode of the first sound generator.

FIG. 11 is a cross-sectional view showing an example of the first sound generator, taken along line II-II' of FIG. 10. FIG. 12 is a view showing an exemplary way of vibrating a vibration layer disposed between a first branch electrode and a second branch electrode of the first sound generator.

Hereinafter, the structure of the first sound generator 510 and a way of vibrating the vibration layer will be described. The structure of the first sound generator 510 and the way of vibrating the vibration layer may be equally applied to the second sound generator 520, the third sound generator 530, and the fourth sound generator 540. Therefore, the structure of the second sound generator 520, the third sound generator 530 and the fourth sound generator 540 and the way of vibrating the vibrating layer will not be described.

Referring to FIGS. 11 and 12, the first sound generator 510 may be a piezoelectric element or a piezoelectric actuator which vibrates the subsidiary areas SS of the display panel 300 using a piezoelectric material that contracts or expands according to the applied voltage. The first sound generator 510 may include a vibration layer 511, a first electrode 512, and a second electrode 513.

The first electrode 512 may include a first first electrode 512A disposed in the first first subsidiary sound generator 510A and a second first electrode 512B disposed in the second first subsidiary sound generator 510B.

The first first electrode 512A may include a first first stem electrode 5121A and first first branch electrodes 5122A, and the second first electrode 512B may include a first second stem electrode 5121B and second second branch electrodes 5122B. The first second electrode 513A may include a first second stem electrode 5131A and first second branch electrodes 5132A, and the second second electrode 513B may include a second second stem electrode 5131B and second second branch electrodes 5132B.

The first first electrode 512A, the first second electrode 513A and a first vibration layer 511A are substantially the same as the second first electrode 512B, the second second electrode 513A and a second vibration layer 511B. Hereinafter, for convenience of description, first first electrode 512A will be described in detail, and any repetitive detailed description of the second first electrode 512B, the second second electrode 513A and the second vibration layer 511B will be omitted.

The first first stem electrode 5121A may be disposed on at least one side of the first vibration layer 511A as shown in FIG. 11. Alternatively, the first first stem electrode 5121A may penetrate a part of the A vibration layer 511A. The first first stem electrode 5121A may be disposed on the upper surface of the A vibration layer 511A. The first first branch electrodes 5122A may branch off from the first first stem electrode 5121A. The first first branch electrodes 5122A may be arranged parallel to each other.

The first second electrode 513A may include a first second stem electrode 5131A and second branch electrodes 5132A. The first second electrode 513A may be disposed spaced apart from the first first electrode 512A. As a result, the first second electrode 513A may be electrically insulated from the first first electrode 512A. The first second stem electrode 5131A may be disposed on at least a side surface of the first vibration layer 511A. In such an embodiment, the first first stem electrode 5121A may be disposed on a first side surface of the first vibration layer 511A while the first second stem electrode 5131A may be disposed on a second side surface of the first vibration layer 511A. Alternatively, the first second stem electrode 5131A may be disposed through a part of the first vibration layer 511A. The first second stem electrode 5131A may be disposed on the upper surface of the first vibration layer 511A. The first second branch electrodes 5132A may branch off from the first second stem electrode 5131A. The first second branch electrodes 5132A may be arranged parallel to each other.

The first first branch electrodes 5122A and the first second branch electrodes 5132A may be arranged in parallel in the vertical direction (Z-axis direction). In addition, the first first branch electrodes 5122A and the first second second branch electrodes 5132 may be arranged alternately in the horizontal direction (X-axis direction or Y-axis direction). In an exemplary embodiment, in the horizontal direction (X-axis direction or Y-axis direction), the first first branch electrodes 5122A and the first second branch electrodes 5132A may be arranged in the order of a first first branch electrode 5122A, a first second branch electrode 5132A, a first first branch electrode 5122A, a first second branch electrodes 5132A, and so on.

The first first electrode 512 and the first second electrode 513 may be connected to pads of the first connection film 810. The pads of the first connection film 810 may be connected to the first first electrode 512A and the first second electrode 513A disposed on the second surface of the first first subsidiary sound generator 510A.

The first vibration layer 511A may be a piezoelectric element that is deformed according to a driving voltage applied to the first first electrode 512A and a driving voltage applied to the first second electrode 513A. In such case, the first vibration layer 511A may include a piezoelectric material such as a poly vinylidene fluoride ("PVDF") film, a plumbum zirconate titanate ("PZT") and an electroactive polymer.

In an exemplary embodiment, the first vibration layer 511A is produced at a high temperature, such that the first first electrode 512A and the first second electrode 513A may be made of silver (Ag) having a high melting point or an alloy of silver (Ag) and palladium (Pd). In such an embodiment, when the first first electrode 512A and the first second electrode 513A include or are made of an alloy of silver (Ag) and palladium (Pd), the content of silver (Ag) may be higher than the content of palladium (Pd) to increase the melting point of the first first electrode 512A and the first second electrode 513A.

The first vibration layer 511A may be disposed between every two of the first first branch electrodes 5122A and the second branch electrodes 5132A. The first vibration layer 511A contracts or expands based on a difference between the driving voltage applied to the first first branch electrodes 5122A and the driving voltage applied to the first second branch electrodes 5132A.

When the polarity direction of the vibration layer 511 disposed between the first branch electrode 5122 and the second branch electrode 5132 disposed under the first branch electrode 5122 is upward direction (↑) as shown in FIG. 12, the vibration layer 511 may have a positive polarity in its upper portion adjacent to the first branch electrodes 5122 and a negative polarity in its lower portion adjacent to the second branch electrodes 5132. In addition, when the polarity direction of the vibration layer 511 disposed between the second branch electrode 5132 and the first branch electrode 5122 disposed under the second branch electrode 5132 is downward direction (↓) the vibration layer 511 may have a negative polarity in its upper portion adjacent to the second branch electrode 5132 and a positive polarity in its lower portion adjacent to the first branch electrode 5122. The polarity direction of the vibration layer 511 may be determined by a poling process of applying an electric field to the vibration layer 511 using the first branch electrodes 5122 and the second branch electrodes 5132.

When the polarity direction of the vibration layer 511 disposed between the first branch electrode 5122 and the second branch electrode 5132 disposed under the first branch electrode 5122 is the upward direction (↑) if the driving voltage having the positive polarity is applied to the first branch electrode 5122 and the driving voltage having the negative polarity is applied to the second branch electrode 5132, the vibration layer 511 may contract according to a first force F1. The first force F1 may be a contractive force. In addition, if the driving voltage having the negative polarity is applied to the first branch electrode 5122 and the driving voltage having the positive polarity is applied to the second branch electrode 5132, the vibration layer 511 may expand according to a second force F2. The second force F2 may be an expanding force.

Similarly, when the polarity direction of the vibration layer 511 disposed between the second branch electrode 5132 and the first branch electrode 5122 disposed under the second branch electrode 5132 is the downward direction (↓) if the first second driving voltage having the positive polarity is applied to the second branch electrode 5132 and the second second driving voltage having the negative polarity is applied to the first branch electrode 5122, the vibration layer 511 may expand according to the expanding force. In addition, when the driving voltage having the negative polarity is applied to the second branch electrode 5132 and the driving voltage having the positive polarity is applied to the first branch electrode 5122, the vibration layer 511 may contract according to a contract force.

When the driving voltage applied to the first electrode 512 and the driving voltage applied to the second electrode 513 have alternately repeated positive and negative polarities, the vibration layer 511 repeatedly contracts and expands. As a result, the first sound generator 510 vibrates. According to an exemplary embodiment of the present disclosure, since the first sound generator 510 is disposed on the inner surface SS1_*i* of the first subsidiary area SS1 and the inner surface SS2_*i* of the second subsidiary area SS2 of the display panel 300, as the vibration layer 511 of the first sound generator 510 contracts and expands, the first subsidiary area SS1 and the second subsidiary area SS2 of the display panel 300 may be vibrated by the stress in the thickness direction, i.e., the first direction (X-axis direction) and/or the second direction (Y-axis direction) of the first subsidiary areas SS1 and SS2 of the display panel 300.

A protective layer 519 may be further disposed on the second surface, the upper surface and the lower surface of the first sound generator 510. The protective layer 519 may include or be formed of an insulating material, or a same material as the vibration layer 511. The protective layer 519 may be disposed on the first electrode 512, the second electrode 513, and the vibration layer 511 exposed without being covered by the first electrode 512 and the second electrode 513. The protective layer 519 may be disposed on the first electrode 512, the second electrode 513, and the vibration layer 511 exposed without being covered by the first electrode 512 and the second electrode 513. Therefore, the vibration layer 511, the first electrode 512 and the second electrode 513 of the sound generator 510 may be protected by the protective layer 519. Alternatively, the protective layer 519 may be omitted.

Figure 14:
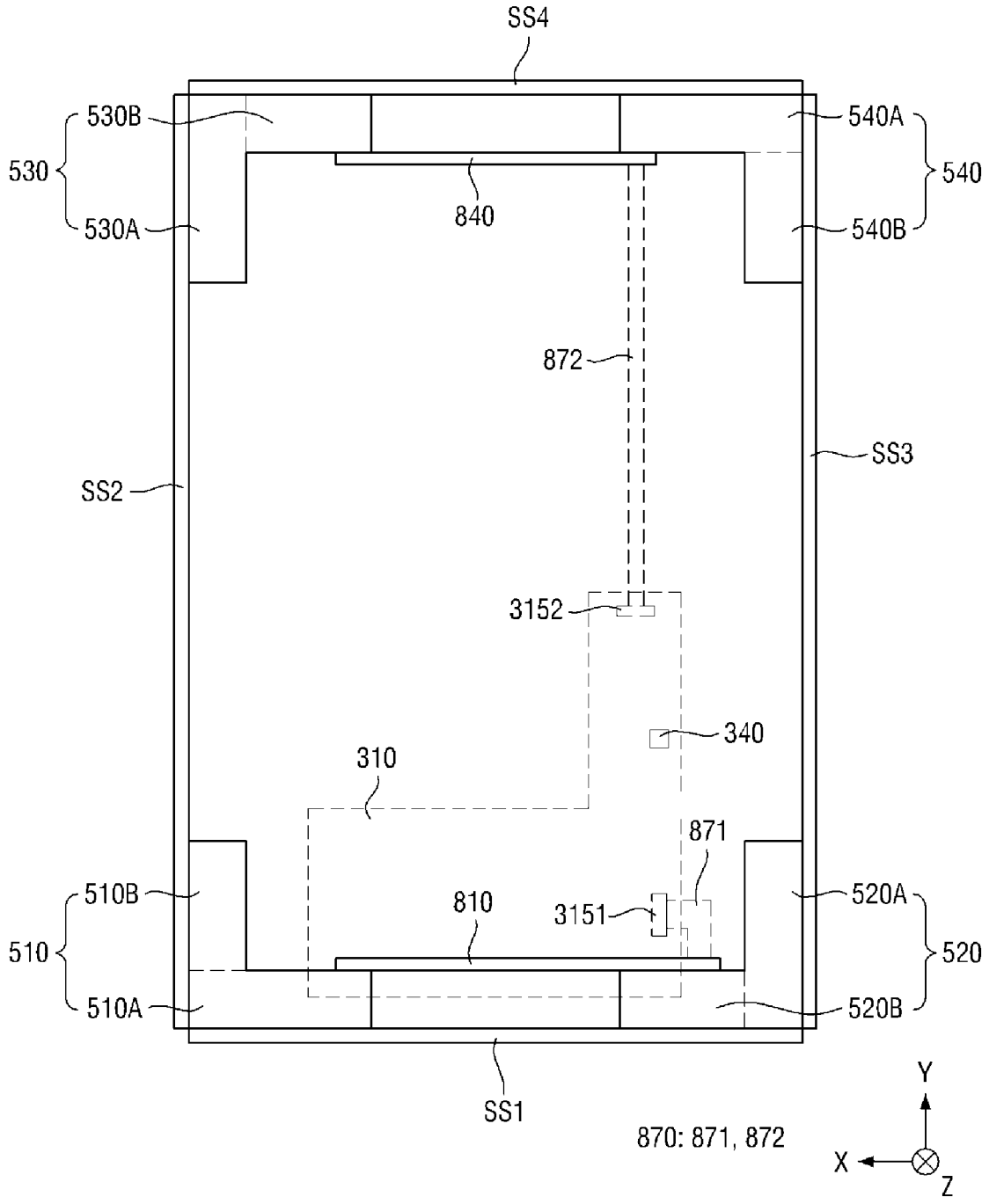
FIG. 14 is a bottom view schematically showing an arrangement of a display panel, sound generators and connection films according to an alternative exemplary embodiment of the disclosure.

FIG. 14 is a bottom view schematically showing an arrangement of a display panel, sound generators and connection films according to an alternative exemplary embodiment of the disclosure.

The exemplary embodiment shown in FIG. 14 is substantially the same as the exemplary embodiment of FIG. 10 except that the second connection film 820 that electrically connects the first sound generator 510 with the third sound generator 530, and the third connection film 830 that electrically connects the second sound generator 520 with the fourth sound generator 540 are omitted. The same or like elements shown in FIG. 14 have been labeled with the same reference characters as used above to describe the exemplary embodiment described above with reference to FIG. 10, and any repetitive detailed description thereof will hereinafter be omitted or simplified.

Referring to FIG. 14, the first sound generator 510 and the second sound generator 520 are electrically connected through the first connection film 810, and the third sound generator 530 and the fourth sound generator 540 are electrically connected through the fourth connection film 840. The first sound generator 510 and the third sound generator 530 are not electrically connected to each other, and the second sound generator 520 and the fourth sound generator 540 are not electrically connected to each other.

The sound connector 315 disposed on a surface of the display circuit board 310 includes a first sound connector 3151 and a second sound connector 3152, and the connection circuit film 870 includes a first connection circuit film 871 and a second connection circuit film 872.

The first connection circuit film 871 electrically connects the first connection film 810 to the first sound connector 3151 disposed on the lower surface of the display panel 300. One end of the first connection circuit film 871 is disposed on one surface of the first connection film 810, and another end of the first connection circuit film 871 is connected to the first sound connector 3151. Accordingly, the first driving voltage and the second driving voltage of the sound driving circuit 340 may be applied to the first sound generator 510 and the second sound generator 520 through the first sound connector 3151, the driving lines of the first connection circuit film 871, and the driving lines of the first connection film 810.

The second connection circuit film 872 electrically connects the fourth connection film 840 to the second sound connector 3152 disposed on the upper side of the display panel 300. One end of the second connection circuit film 872 is disposed on one surface of the fourth connection film 840, and another end of the second connection circuit film 872 is connected to the second sound connector 3152. Accordingly, the first driving voltage and the second driving voltage of the sound driving circuit 340 may be applied to the third sound generator 530 and the fourth sound generator 540 through the second sound connector 3152, the driving lines of the second connection circuit film 872, and the driving lines of the fourth connection film 840.

Figure 15:
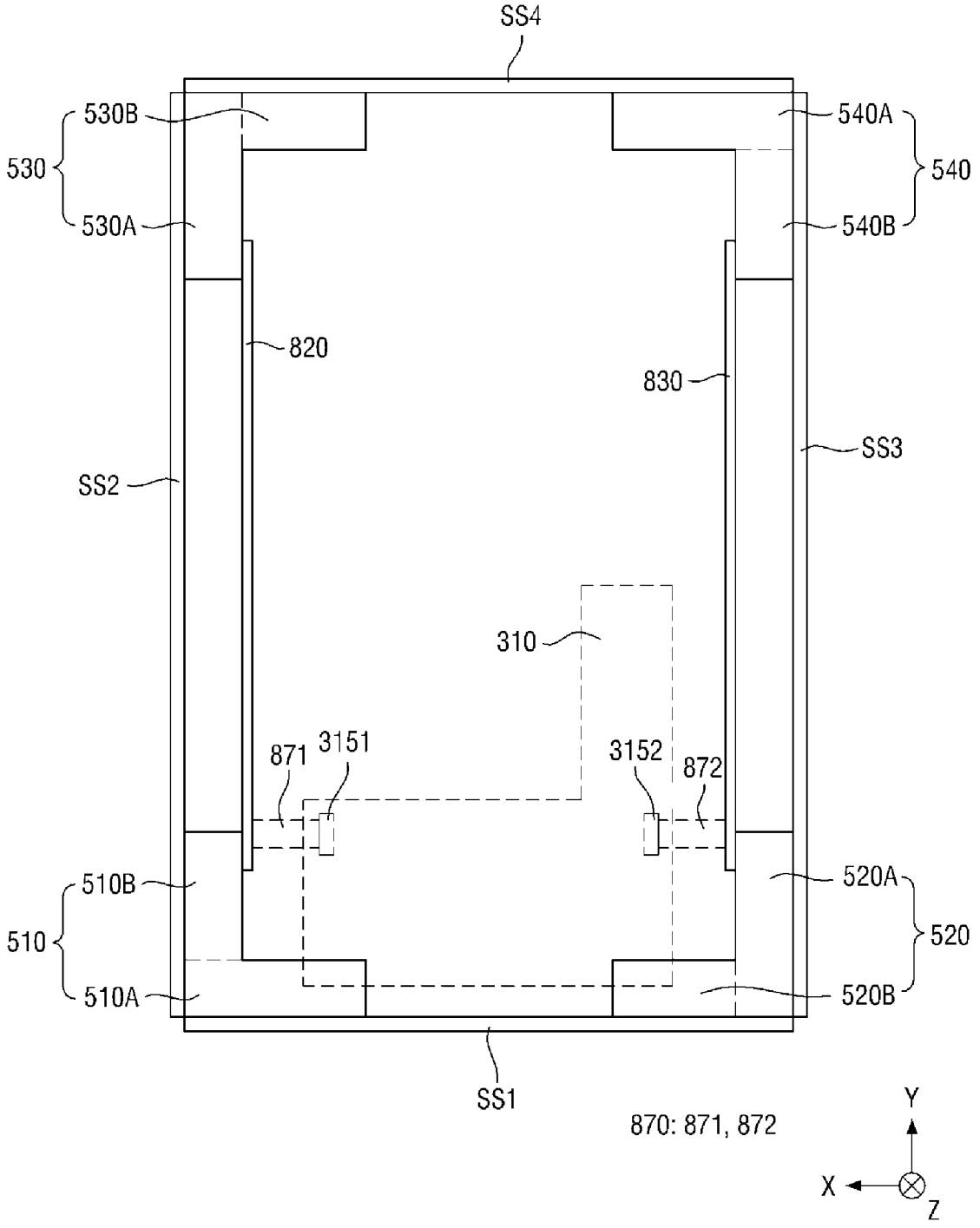
FIG. 15 is a bottom view schematically showing an arrangement of a display panel, sound generators and connection films according to another alternative exemplary embodiment of the disclosure.

FIG. 15 is a bottom view schematically showing an arrangement of a display panel, sound generators and connection films according to another alternative exemplary embodiment of the disclosure.

The exemplary embodiment shown in FIG. 15 is substantially the same as the exemplary embodiment of FIG. 10 except that the first connection film 810 that electrically connects the first sound generator 510 with the second sound generator 520, and the fourth connection film 840 that electrically connects the third sound generator 530 with the fourth sound generator 540 are omitted. The same or like elements shown in FIG. 15 have been labeled with the same reference characters as used above to describe the exemplary embodiment described above with reference to FIG. 10, and any repetitive detailed description thereof will hereinafter be omitted or simplified.

Referring to FIG. 15, the first sound generator 510 and the third sound generator 530 are electrically connected to each other through the second connection film 820, and the second sound generator 520 and the fourth sound generator 540 are electrically connected to each other through the third connection film 830. The first sound generator 510 and the second sound generator 520 are not electrically connected to each other, and the third sound generator 530 and the fourth sound generator 540 are not electrically connected to each other.

The sound connector 315 disposed on a surface of the display circuit board 310 includes a first sound connector 3151 and a second sound connector 3152, and the connection circuit film 870 includes a first connection circuit film 871 and a second connection circuit film 872.

The first connection circuit film 871 electrically connects the second connection film 820 with the first sound connector 3151 disposed on the right side of the display panel 300. One end of the first connection circuit film 871 is disposed on one surface of the second connection film 820, and another end of the first connection circuit film 871 is connected to the first sound connector 3151. Accordingly, the first driving voltage and the second driving voltage of the sound driving circuit 340 may be applied to the first sound generator 510 and the third sound generator 530 through the first sound connector 3151, the driving lines of the first connection circuit film 871, and the driving lines of the second connection film 820.

The second connection circuit film 872 electrically connects the third connection film 830 with the second sound connector 3152 disposed on the left side of the display panel 300. One end of the second connection circuit film 872 is disposed on one surface of the third connection film 830, and another end of the second connection circuit film 872 is connected to the second sound connector 3152. Accordingly, the first driving voltage and the second driving voltage of the sound driving circuit 340 may be applied to the second sound generator 520 and the fourth sound generator 540 through the second sound connector 3152, the driving lines of the second connection circuit film 872, and the driving lines of the third connection film 830.

In an exemplary embodiment shown in FIGS. 14 and 15, the sound generators 510, 520, 530 and 540 may be driven with the single sound driving circuit 340 even without electrically connecting all of the sound generators 510, 520, 530 and 540 with one another, such that the area occupied by the sound driving circuit 340 may be reduced.

Figure 16:
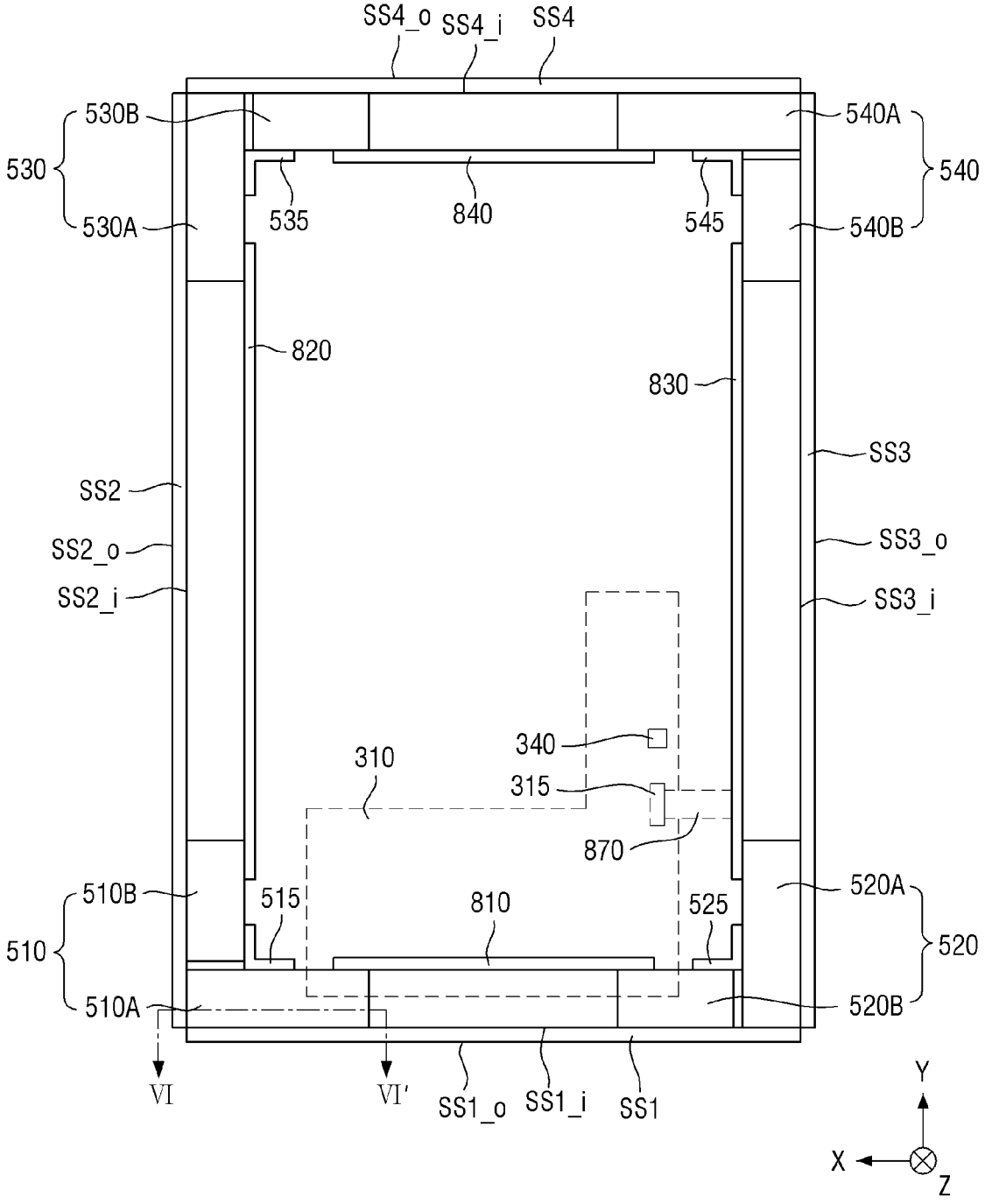
FIG. 16 is a bottom view schematically showing an arrangement of a display panel, sound generators and connection films according to yet another alternative exemplary embodiment of the disclosure.
Figure 17:
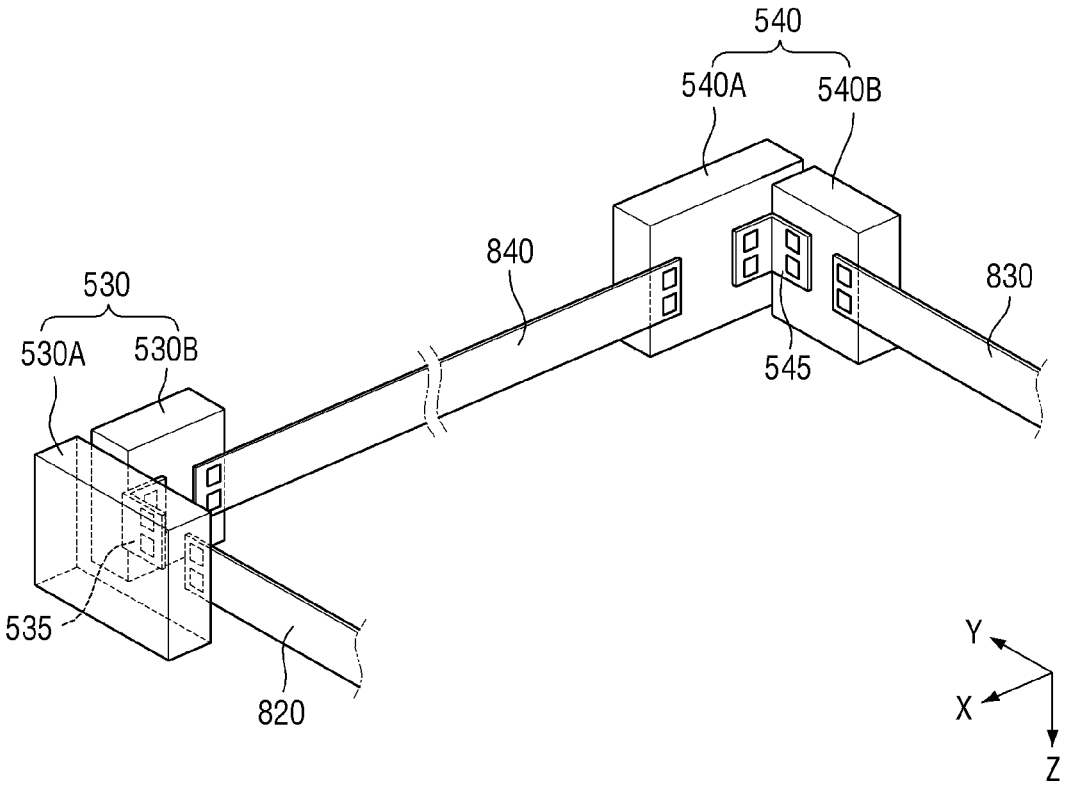
FIG. 17 is an enlarged perspective view showing a connection relationship between two sound generators including the subsidiary sound generators of FIG. 16.

FIG. 16 is a bottom view schematically showing an arrangement of a display panel, sound generators and connection films according to yet another alternative exemplary embodiment of the disclosure. FIG. 17 is an enlarged perspective view showing a connection relationship between sound generators including the subsidiary sound generators of FIG. 16.

The exemplary embodiment of FIGS. 16 to 17 is substantially the same as the exemplary embodiment of FIG. 10 except that the subsidiary sound generators of each of sound generators are spaced apart from each other. The same or like elements shown in FIGS. 16 and 17 have been labeled with the same reference characters as used above to describe the exemplary embodiment described above with reference to FIG. 10, and any repetitive detailed description thereof will hereinafter be omitted or simplified.

The first sound generator 510 may include a first first subsidiary sound generator 510A and a second first subsidiary sound generator 510B. The first first subsidiary sound generator 510A and the second first subsidiary sound generator 510B may be spaced apart from each other at the first corner.

The first first subsidiary sound generator 520 and the second first subsidiary sound generator 510B may be connected to each other through the first subsidiary connection film 515. One end of the first subsidiary connection film 515 may be disposed on the second surface of the first first subsidiary sound generator 510A, and another end of the first subsidiary connection film 515 may be disposed on the second surface of the second first subsidiary sound generator 510B. The first first subsidiary sound generator 510A and the second first subsidiary sound generator 510B may be electrically connected to each other through the first driving line and the second driving line disposed in the first subsidiary connection film 515.

The second sound generator 520 may include a first second subsidiary sound generator 520A and a second second subsidiary sound generator 520B. The first second subsidiary sound generator 520A and the second second subsidiary sound generator 520B may be spaced apart from each other at the second corner.

The first second subsidiary sound generator 525 and the second second subsidiary sound generator 520B may be electrically connected to each other through the second subsidiary connection film 525. One end of the second subsidiary connection film 525 may be disposed on the second surface of the first second subsidiary sound generator 520A, and another end of the second subsidiary connection film 525 may be disposed on the second surface of the second second subsidiary sound generator 520B. The first second subsidiary sound generator 520A and the second second subsidiary sound generator 520B may be electrically connected to each other through the first driving line and the second driving line disposed in the second subsidiary connection film 525.

The third sound generator 530 may include a first third subsidiary sound generator 530A and a second third subsidiary sound generator 530B. The first third subsidiary sound generator 530A and the second third subsidiary sound generator 530B may be spaced apart from each other at the third corner.

The first third subsidiary sound generator 530A and the second third subsidiary sound generator 530B may be electrically connected to each other through the third subsidiary connection film 535. One end of the third subsidiary connection film 535 may be disposed on the second surface of the first third subsidiary sound generator 530A, and another end of the third subsidiary connection film 535 may be disposed on the second surface of the second third subsidiary sound generator 530B. The first third subsidiary sound generator 530A and the second third subsidiary sound generator 530B may be electrically connected to each other through the first driving line and the second driving line disposed in the third subsidiary connection film 535.

The fourth sound generator 540 may include a first fourth subsidiary sound generator 540A and a second fourth subsidiary sound generator 540B. The first fourth subsidiary sound generator 540A and the second fourth subsidiary sound generator 540B may be spaced apart from each other at the fourth corner.

The first fourth subsidiary sound generator 540A and the second fourth subsidiary sound generator 540B may be electrically connected to each other through the fourth subsidiary connection film 545. One end of the fourth subsidiary connection film 545 may be disposed on the second surface of the first fourth subsidiary sound generator 540A, and another end of the fourth subsidiary connection film 545 may be disposed on the second surface of the second fourth subsidiary sound generator 540B. The first fourth subsidiary sound generator 540A and the second fourth subsidiary sound generator 540B may be electrically connected to each other through the first driving line and the second driving line disposed in the fourth subsidiary connection film 545.

According to an exemplary embodiment of the disclosure, as shown in FIGS. 16 and 17, the subsidiary sound generators that define each of the sound generators are spaced apart from each other at each of the corners of the display panel 300, such that it is possible to prevent damage to the sound generators 510, 520, 530 and 540 that may occur at each of the corners due to a shock when the display device 1 is dropped.

Figure 18:
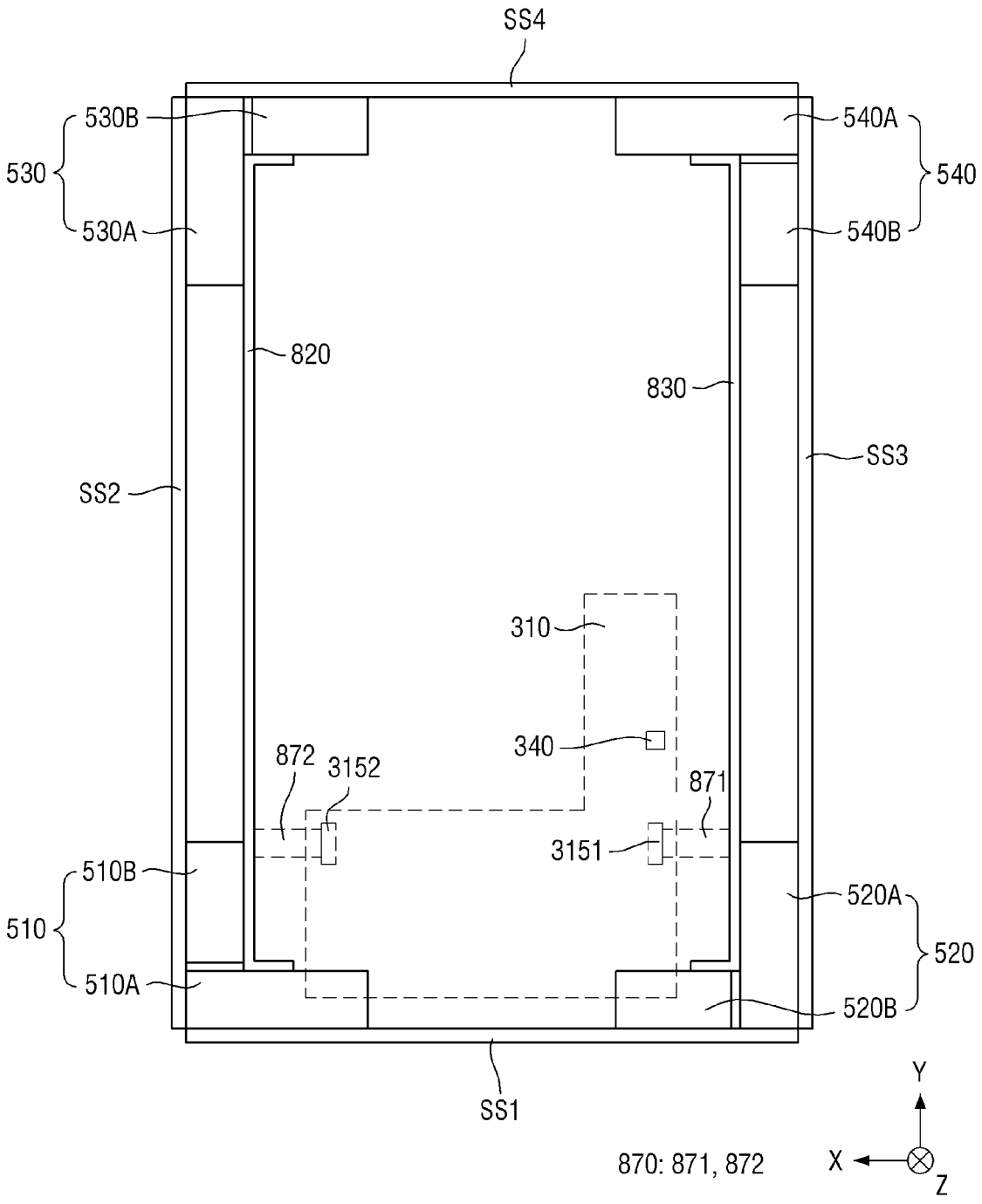
FIG. 18 is a bottom view schematically showing an arrangement of a display panel, sound generators and connection films according to yet another alternative exemplary embodiment of the disclosure.

FIG. 18 is a bottom view schematically showing an arrangement of a display panel, sound generators and connection films according to yet another alternative exemplary embodiment of the present disclosure.

The exemplary embodiment shown in FIG. 18 is substantially the same as the exemplary embodiment shown in FIG. 16 except that the first first subsidiary sound generator 510A, the first second subsidiary sound generator 510B, the first third subsidiary sound generator 530A, and the second third subsidiary sound generator 530B are qelectrically connected to one another through a second connection film 820, and that the first second subsidiary sound generator 520A, the second second subsidiary sound generator 520B, the first fourth subsidiary sound generator 540A, and the second fourth subsidiary sound generator 540B are electrically connected to one another through the third connection film 830. The same or like elements shown in FIG. 18 have been labeled with the same reference characters as used above to describe the exemplary embodiment described above with reference to FIGS. 10 and 16, and any repetitive detailed description thereof will hereinafter be omitted or simplified.

Referring to FIG. 18, a first first subsidiary sound generator 510A, a first second subsidiary sound generator 510B, a first third subsidiary sound generator 530A and a second third subsidiary sound generator 530B may be connected with one another through a second connection film 820. The second connection film 820 may be disposed entirely on the second surface of the second first subsidiary sound generator 510B and the first third subsidiary sound generator 530A to extend in the second direction Y and may be disposed on at least a portion of the second surface of the first first subsidiary sound generator 510A and the second third subsidiary sound generator 530B.

In such an embodiment, the first second subsidiary sound generator 520A, the second second subsidiary sound generator 520B, the first fourth subsidiary sound generator 540A and the second fourth subsidiary sound generator 540B may be connected with one another through a third connection film 830. The third connection film 830 may be disposed entirely on the second surface of the first second subsidiary sound generator 520A and the second fourth subsidiary sound generator 540B to extend in the second direction Y and may be disposed on at least a portion of the second surface of the second second subsidiary sound generator 520B and the first fourth subsidiary sound generator 540A.

According to an exemplary embodiment of the disclosure, the adjacent subsidiary sound generators are connected to each other by the connection films instead of subsidiary connection films, the plurality of subsidiary sound generators disposed at different corners may be electrically connected to each other.

Figure 19:
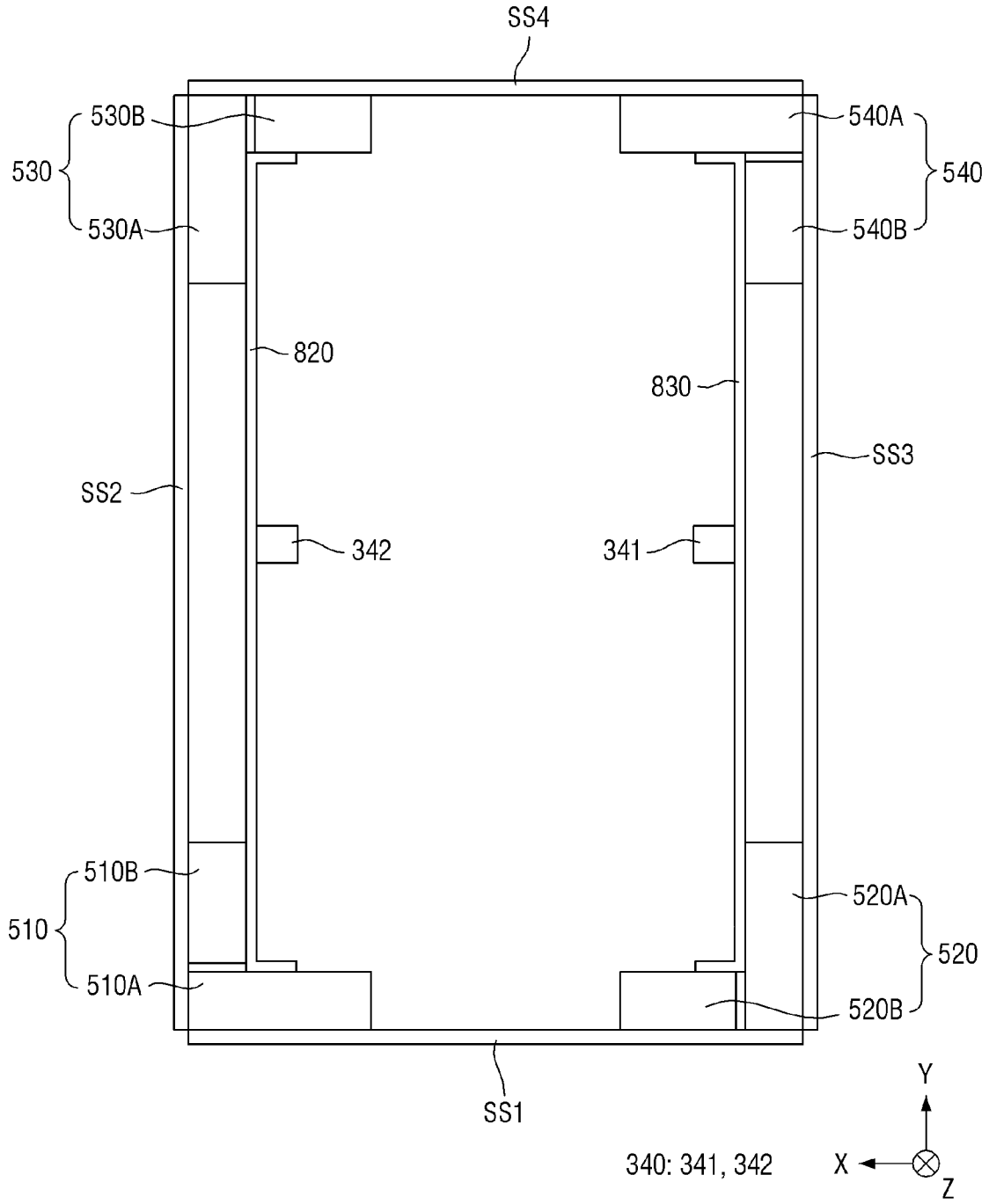
FIG. 19 is a bottom view schematically showing an arrangement of a display panel, sound generators and connection films according to yet another alternative exemplary embodiment of the disclosure.

FIG. 19 is a bottom view schematically showing an arrangement of a display panel, sound generators and connection films according to yet another alternative exemplary embodiment of the present disclosure.

The exemplary embodiment of FIG. 19 is substantially the same as the exemplary embodiment shown in FIG. 18 except that the sound driving circuit 340 includes the first sound driving circuit 341 and the second sound driving circuit 342, and the sound driving circuits 341 and 342 are not disposed on the display circuit board 310. The same or like elements shown in FIG. 19 have been labeled with the same reference characters as used above to describe the exemplary embodiment described above with reference to FIGS. 10 and 18, and any repetitive detailed description thereof will hereinafter be omitted or simplified.

Referring to FIG. 19, the sound driving circuit 340 may include a first sound driving circuit 341 and a second sound driving circuit 342. The sound driving circuits 341 and 342 may be disposed on the second connection film 820 and the third connection film 830. It is, however, to be understood that the disclosure is not limited thereto. The sound driving circuits 341 and 342 may be spaced apart from the second connection film 820 and the third connection film 830, and may be electrically connected to the second connection film 820 and the third connection film 830 by another connection member. Hereinafter, an exemplary embodiment where the sound driving circuits 341 and 342 are disposed on the second connection film 820 and the third connection film 830 will be described.

The first sound driving circuit 341 may be disposed on the third connection film 830. The first driving voltage and the second driving voltage of the first sound driving circuit 341 may be applied to the electrode pads of the first second subsidiary sound generator 520A, the second second subsidiary sound generator 520B, the first fourth subsidiary sound generator 540A and the second fourth subsidiary sound generator 540B through the first driving line and the second driving line of the third connection film 830.

The second sound driving circuit 342 may be disposed on the second connection film 820. The first driving voltage and the second driving voltage of the second sound driving circuit 342 may be applied to the electrode pads of the first first subsidiary sound generator 510A, the second first subsidiary sound generator 510B, the first third subsidiary sound generator 530A and the second third subsidiary sound generator 530B through the first driving line and the second driving line of the second connection film 820.

The first sound driving circuit 341 may drive the second sound generator 520 and the fourth sound generator 540 disposed on the left side inside the subsidiary areas SS of the display panel 300, and the second sound driving circuit 342 may drive the first sound generator 510 and the third sound generator 530 disposed on the right side inside the subsidiary areas SS of the display panel 300. Accordingly, the first sound driving circuit 341 and the second sound driving circuit 342 may drive the pairs of the sound generators 510, 520, 530 and 540 independently of each other.

In such an embodiment, as the first sound driving circuit 341 is driven, the second sound generator 520 and the fourth sound generator 540 vibrates the first subsidiary area SS1, the third subsidiary area SS3 and the fourth subsidiary area SS4 of the display panel 300, where the second sound generator 520 and the fourth sound generator 540 are disposed, in the thickness direction of each side surface of the display panel 300, to output a first sound.

In such an embodiment, as the second sound driving circuit 342 is driven, the first sound generator 510 and the third sound generator 530 vibrates the first subsidiary area SS1, the second subsidiary area SS2 and the fourth subsidiary area SS4 of the display panel 300, where the first sound generator 510 and the third sound generator 530 are disposed, in the thickness direction of each side surface of the display panel 300, to output a second sound.

Therefore, according to an exemplary embodiment of the disclosure, the left and right sides of the display panel 300 are driven independently of each other by the plurality of sound circuit boards 341 and 342, respectively, thereby outputting first and second sounds independently of each other to provide stereo sound.

Figure 20:
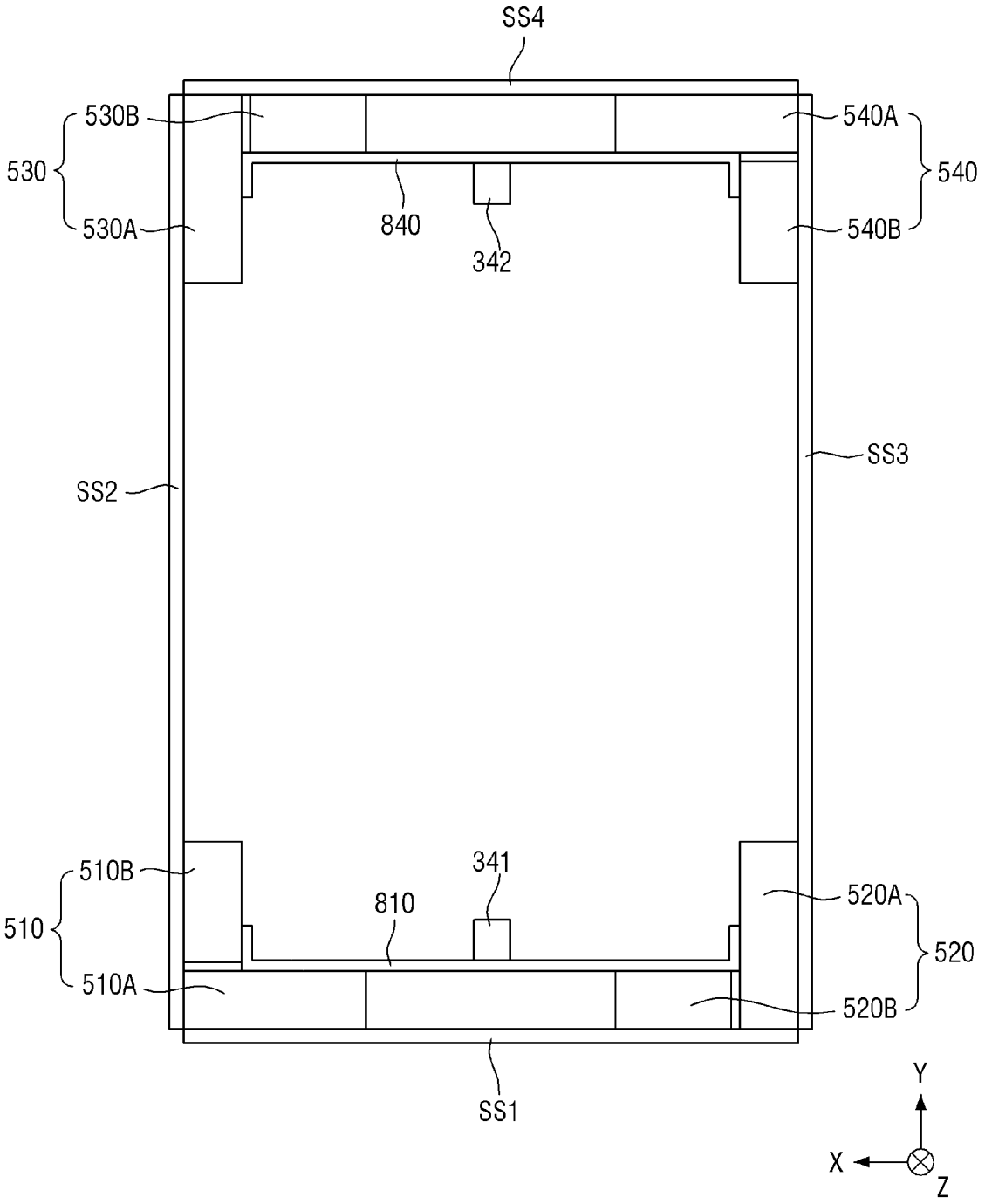
FIG. 20 is a bottom view schematically showing an arrangement of a display panel, sound generators and connection films according to yet another alternative exemplary embodiment of the disclosure.

FIG. 20 is a bottom view schematically showing an arrangement of a display panel, sound generators and connection films according to yet another alternative exemplary embodiment of the disclosure.

The exemplary embodiment shown in FIG. 20 is substantially the same as the exemplary embodiment shown in FIG. 19 except that a first sound driving circuit 341 is disposed on a first connection film 810 and a second sound driving circuit 342 is disposed on a fourth connection film 840 so that the upper side and the lower side of the display panel 300 can be driven separately by a plurality of sound driving circuits 341 and 342. The same or like elements shown in FIG. 20 have been labeled with the same reference characters as used above to describe the exemplary embodiment described above with reference to FIGS. 10 and 19, and any repetitive detailed description thereof will hereinafter be omitted or simplified.

In an exemplary embodiment, the first first subsidiary sound generator 510A, the second first subsidiary sound generator 510B, the first second subsidiary sound generator 520A and the second second subsidiary sound generator 520B are electrically connected to one another through the first connection film 810, the first third subsidiary sound generator 530A, the second third subsidiary sound generator 530B, the first fourth subsidiary sound generator 540A and the second fourth subsidiary sound generator 540B are electrically connected to one another through the fourth connection film 840.

The first sound driving circuit 341 is disposed on the first connection film 810, so that the first driving voltage and the second driving voltage of the first sound driving circuit 341 may be applied to the electrode pads of the first first subsidiary sound generator 510A, the second first subsidiary sound generator 510B, the first second subsidiary sound generator 520A and the second second subsidiary sound generator 520B through the first driving line and the second driving line of the first connection film 810.

The second sound driving circuit 342 may be disposed on the fourth connection film 840. The first driving voltage and the second driving voltage of the second sound driving circuit 342 may be applied to the electrode pads of the first third subsidiary sound generator 530A, the second third subsidiary sound generator 530B, the first fourth subsidiary sound generator 540A and the second fourth subsidiary sound generator 540B through the first driving line and the second driving line of the fourth connection film 840.

The first sound driving circuit 341 may drive the first sound generator 510 and the second sound generator 520 disposed on the lower side inside the subsidiary areas SS of the display panel 300, and the second sound driving circuit 342 may drive the pair of the third sound generator 530 and the fourth sound generator 540 disposed on the upper side inside the subsidiary areas SS of the display panel 300.

In such an embodiment, as the first sound driving circuit 341 is driven, the first sound generator 510 and the second sound generator 520 vibrates the first subsidiary area SS1, the second subsidiary area SS2 and the third subsidiary area SS3 of the display panel 300, where the first sound generator 510 and the second sound generator 520 are disposed, in the thickness direction of each side surface of the display panel 300, to output a first sound.

In such an embodiment, as the second sound driving circuit 342 is driven, the third sound generator 530 and the fourth sound generator 540 vibrates the second subsidiary area SS2, the third subsidiary area SS3 and the fourth subsidiary area SS4 of the display panel 300, where the third sound generator 530 and the fourth sound generator 540 are disposed, in the thickness direction of each side surface of the display panel 300, to output a second sound.

Therefore, according to an exemplary embodiment of the disclosure, the upper and lower sides of the display panel 300 are driven independently of each other by the plurality of sound circuit boards 341 and 342, respectively, thereby outputting first and second sounds independently of each other to provide stereo sound.

Figure 21:
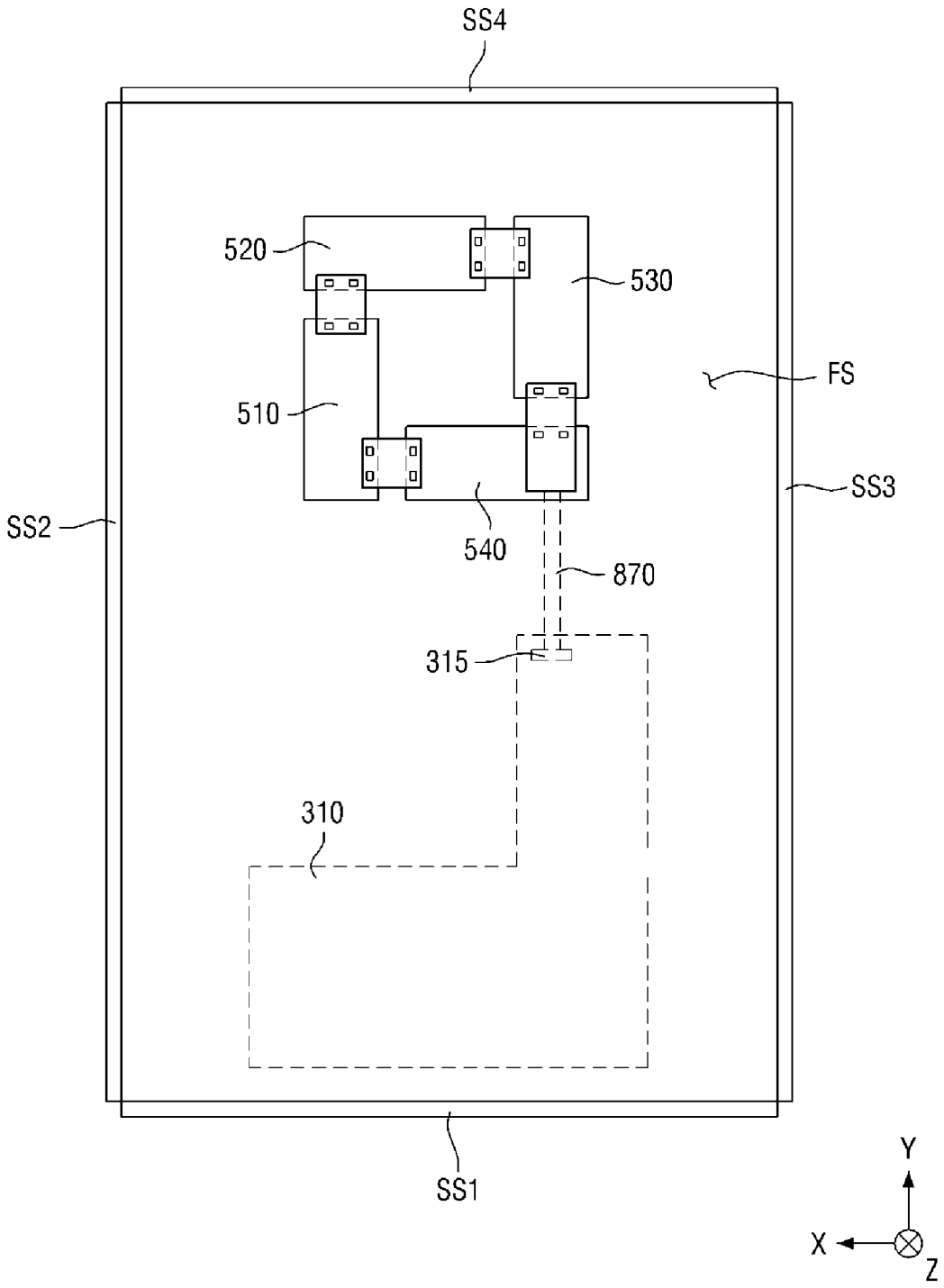
FIG. 21 is a bottom view schematically showing an arrangement of a display panel, sound generators and connection films according to yet another alternative exemplary embodiment of the disclosure.

FIG. 21 is a bottom view schematically showing an arrangement of a display panel, sound generators and connection films according to yet another alternative exemplary embodiment of the disclosure.

Referring to FIG. 21, the sound generators 510, 520, 530 and 540 may be disposed under the main area FS of the display panel 300. The sound generators 510, 520, 530 and 540 may be spaced apart from one another. The sound generators 510, 520, 530 and 540 spaced apart from one another may be electrically connected to one another through a plurality of connection films. The connection circuit film 870 may be disposed on at least one side of the sound generators 510, 520, 530 and 540 that are all electrically connected with one another through the plurality of connection films. Another end of the connection circuit film 870 connected to the sound generator may be connected to the sound connector 315 disposed on the display circuit board 310. Therefore, the plurality of sound generators 510, 520, 530 and 540 may be integrated as a single piece by the connection film to be driven together by a single sound driving circuit.

First surfaces of the sound generators 510, 520, 530 and 540 are disposed on the main area FS of the display panel 300. When the first driving voltage and the second driving voltage of the sound driving circuit 340 are applied to the electrode pads of the sound generators 510, 520, 530 and 540, the main area FS of the display panel 300 may vibrate in the thickness direction of the main area FS of the display panel 300 by the sound generators 510, 520, 530 and 540. Accordingly, in such an embodiment, the display panel 300 of the display device 1 may output sound as the display panel 300 vibrates in the third direction (Z-axis direction).

Figure 22:
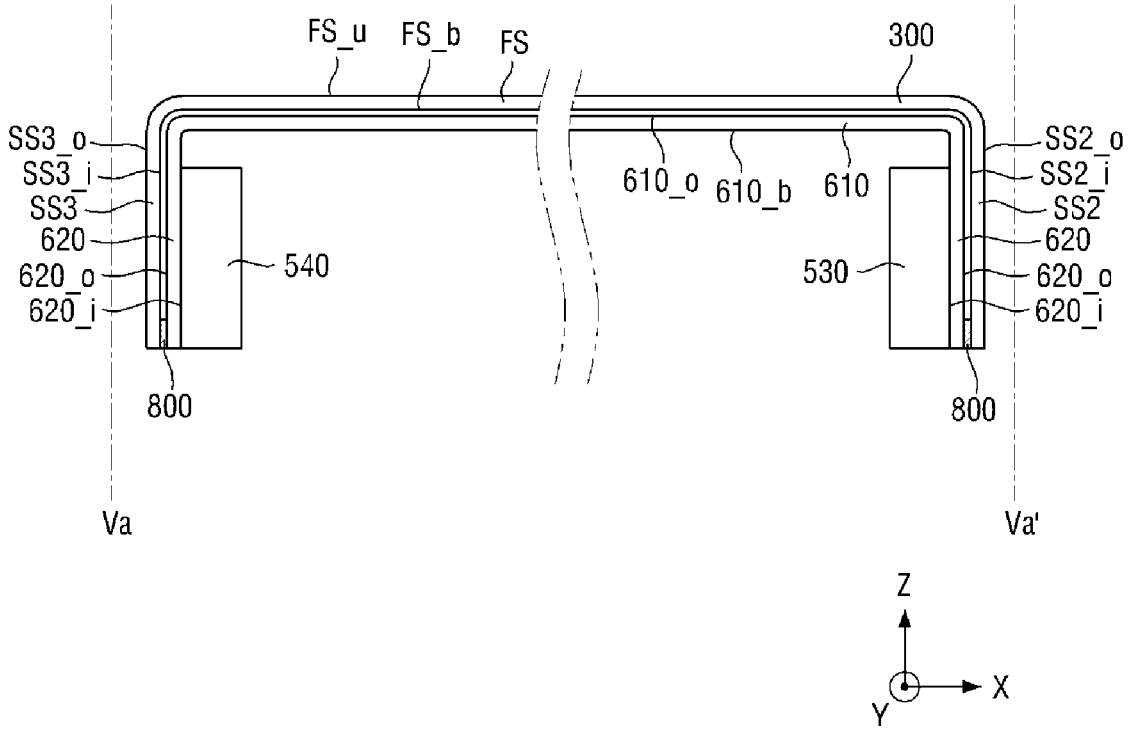
FIG. 22 is a cross-sectional view showing an alternative exemplary embodiment corresponding to FIG. 5A.

FIG. 22 is a cross-sectional view showing an alternative exemplary embodiment corresponding to FIG. 5A.

Referring to FIG. 22, the bracket 600 may be disposed under the display panel 300. The bracket 600 may be spaced apart from the display panel 300. The bracket 600 may include an upper portion 610 and side portions 620. The shape of the bracket 600 may be substantially to the same as the shape of the display panel 300. Therefore, the upper portion 610 of the bracket 600 may be disposed under the main area FS of the display panel 300 to be in parallel with the main area FS of the display panel 300, and the side portions 620 of the bracket 600 may be disposed on the inner side of the subsidiary areas SS of the display panel 300 to be in parallel with the subsidiary areas SS of the display panel 300, respectively.

A top surface 610_*o* of the upper portion 610 and outer surfaces 620_*o* and 620_*o* of the side portion 620 of the bracket 600 may face the display panel 300, and a bottom surface 610_*b* of the upper portion 610 and inner surfaces 610_*i* and 620_*i* of the side portions 620 of the bracket 600 may be opposite surfaces of the top surface 610_*o* of the upper portion 610 and the outer surfaces 620_*o* and 620_*o* of the side portion 620. The sound generators 510, 520, 530 and 540 may be disposed on the inner surface 620_*i* of the side portions 620 of the bracket 600. Accordingly, the side portions 620 of the bracket 600 may vibrate by the sound generators 510, 520, 530 and 540. The vibration of the bracket 600 fixed to the display panel 300 may be transmitted to each of the subsidiary areas SS of the display panel 300 to output sound by the vibration of the display panel 300.

A waterproof member 800 may be disposed at an edge of the bracket 600 in the space between the bracket 600 and the display panel 300. In one exemplary embodiment, for example, the waterproof member 800 may be disposed in a way such that the waterproof member 800 surrounds the ends of the side portions 620 of the bracket 600. It is, however, to be understood that this is merely illustrative, and not being limited thereto.

Figure 23:
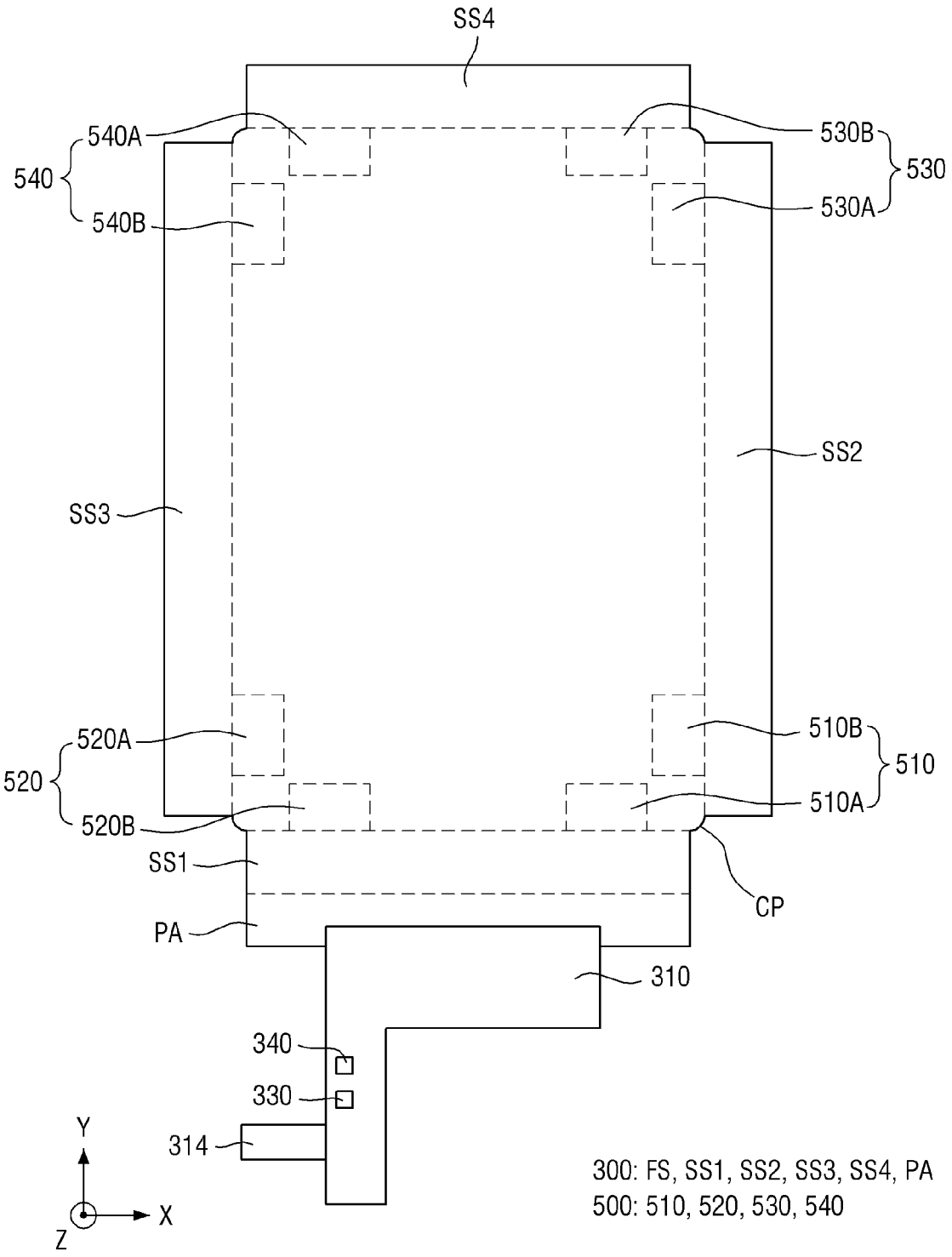
FIG. 23 is a development view showing an alternative exemplary embodiment of the display panel of FIG. 2.
Figure 24:
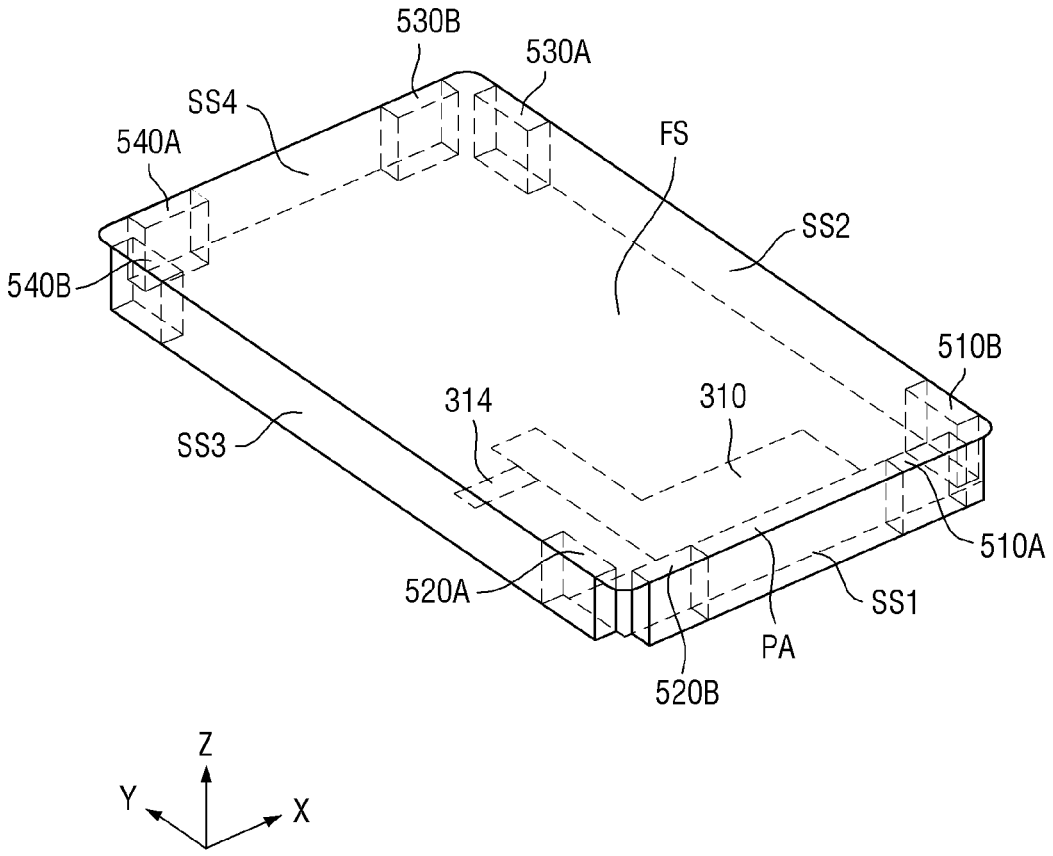
FIG. 24 is a perspective view of an arrangement of the display panel and the sound generators of FIG. 23.
Figure 25:
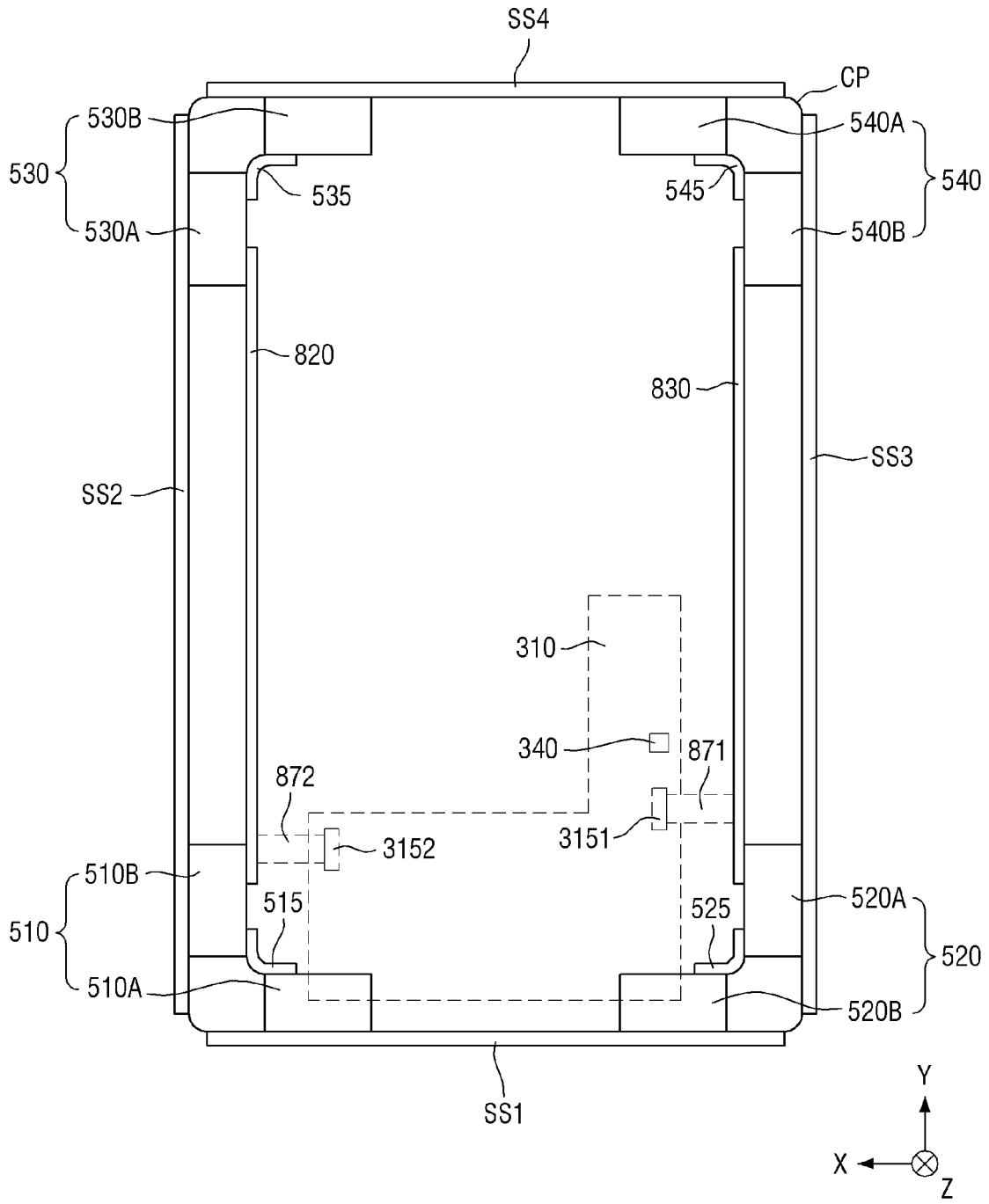
FIG. 25 is a bottom view schematically showing an arrangement of the display panel, the sound generators, and the connection films of FIG. 23.

FIG. 23 is a development view showing an alternative exemplary embodiment of a display panel. FIG. 24 is a perspective view of a display panel and sound generators of FIG. 23. FIG. 25 is a bottom view schematically showing an arrangement of the display panel, the sound generators, and the connection films of FIG. 24.

The exemplary embodiment shown in FIGS. 23 to 25 is substantially the same as the exemplary embodiment of FIGS. 3 and 4 except that corner portions CP are further defined between the subsidiary areas SS of the display panel 300. The same or like elements shown in FIGS. 23 to 25 have been labeled with the same reference characters as used above to describe the exemplary embodiment described above with reference to FIGS. 3 and 4, and any repetitive detailed description thereof will hereinafter be omitted or simplified Referring to FIGS. 23 to 25, each of the corner portions CP of the display panel 300 may be a space between the subsidiary areas SS. The sound generators 500 may not be disposed at the corner portions CP of the display panel 300. Accordingly, the subsidiary sound generators may be spaced apart from each other, instead of being integrally formed as a single unitary unit to define the sound generators 510, 520, 530 and 540.

In one exemplary embodiment, for example, the first first subsidiary sound generator 510A may be disposed only on the first subsidiary area SS1, and the second first subsidiary sound generator 510B may be disposed only on the second subsidiary area SS2. Therefore, the first first subsidiary sound generator 510A may vibrate the first subsidiary area SS1 of the display panel 300 in the thickness direction, and the second first subsidiary sound generator 510B may vibrate the second subsidiary area SS2 of the display panel 300 in the thickness direction, to output sound.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a display panel including a main area, a first subsidiary area extending from a first side of the main area, and a second subsidiary area extending from a second side of the main area; and a first sound generator disposed on the first subsidiary area and the second subsidiary area of the display panel, wherein the first sound generator generates a sound by vibrating the first subsidiary area and the second subsidiary area of the display panel, and wherein the first side extends in a first direction and the second side extends in a second direction crossing the first direction, the first direction and the second direction defining a plane in which an entirety of the main area is disposed therein, wherein the first subsidiary area and the second first subsidiary area are not disposed in the plane, and wherein the first side and the second side are disposed adjacently with a corner portion interposed therebetween.

2. The display device of claim 1, wherein the first sound generator is bent at least once.

3. The display device of claim 1, wherein the first side and the second side of the main area do not face each other.

4. A display device comprising:

a display panel including a main area, a first subsidiary area extending from a first side of the main area, and a second subsidiary area extending from a second side of the main area; and a first sound generator disposed on the first subsidiary area and the second subsidiary area of the display panel, wherein the first sound generator generates a sound by vibrating the first subsidiary area and the second subsidiary area of the display panel, and wherein the first side extends in a first direction and the second side extends in a second direction crossing the first direction, and wherein the first side and the second side are disposed adjacently with a corner portion interposed therebetween, wherein the display panel further include a third subsidiary area extending from a third side of the main area that faces the second side, and wherein the display device further comprises a second sound generator disposed on the first subsidiary area and the third subsidiary area of the display panel, wherein the second sound generator generates a sound by vibrating the first subsidiary area and the third subsidiary area of the display panel.

5. The display device of claim 4, wherein the first sound generator is spaced apart from the second sound generator.

6. The display device of claim 4, further comprising:

a first connection film which connects the first sound generator and the second sound generator to each other.

7. The display device of claim 4, wherein the display panel further include a fourth subsidiary area extending from a fourth side of the main area which faces the first side, and wherein the display device further comprises a third sound generator disposed on the second subsidiary area and the fourth subsidiary area of the display panel, wherein the third sound generator generates a sound by vibrating the second subsidiary area and the fourth subsidiary area of the display panel.

8. The display device of claim 7, further comprising:

a second connection film which connects the first sound generator and the third sound generator to each other.

9. The display device of claim 7, further comprising:

a fourth sound generator disposed on the third subsidiary area and the fourth subsidiary area of the display panel, wherein the fourth sound generator generates a sound by vibrating the third subsidiary area and the fourth subsidiary area of the display panel.

10. The display device of claim 9, further comprising:

a third connection film which connects the second sound generator and the fourth sound generator to each other.

11. The display device of claim 9, further comprising:

a fourth connection film which connects the third sound generator and the fourth sound generator to each other.

12. The display device of claim 9, further comprising:

a circuit board disposed on a pad area extending from one of the first to fourth subsidiary areas of the display panel; and a plurality of connection films which connects the first to fourth sound generators to one another, wherein the plurality of connection films comprise:

a first connection film which connects the first sound generator and the second sound generator to each other, a second connection film which connects the first sound generator and the third sound generator to each other, a third connection film which connects the second sound generator and the fourth sound generator to each other, and a fourth connection film which connects the third sound generator and the fourth sound generator to each other, wherein the display device further comprises a first connection circuit film which connects the circuit board to one of the first to fourth connection films.

13. The display device of claim 9, further comprising:

a circuit board disposed on a pad area extending from one of the first to fourth subsidiary areas of the display panel;

a first connection film which connects the first sound generator and the second sound generator to each other;

a second connection film which connects the third sound generator and the fourth sound generator to each other;

a first connection circuit film which connects the circuit board to the first connection film; and a second connection circuit film which connects the circuit board to the second connection film.

14. The display device of claim 9, further comprising:

a circuit board disposed on a pad area extending from one of the first to fourth subsidiary areas of the display panel;

a first connection film which connects the first sound generator and the third sound generator to each other;

a second connection film which connects the second sound generator and the fourth sound generator to each other;

a first connection circuit film which connects the circuit board to the first connection film; and a second connection circuit film which connects the circuit board to the second connection film.

15. The display device of claim 9, further comprising:

a first connection film which connects the first sound generator and the second sound generator to each other; and a second connection film which connects the third sound generator and the fourth sound generator to each other.

16. The display device of claim 15, further comprising:

a first sound driving circuit which generates first sound driving voltages;

a second sound driving circuit which generates second sound driving voltages;

a first connection circuit film which connects the first sound driving circuit to the first connection film; and a second connection circuit film which connects the second sound driving circuit to the second connection film.

17. A display device comprising:

a display panel including a main area, a first subsidiary area extending from a first side of the main area, and a second subsidiary area extending from a second side of the main area; and a first sound generator comprising:

a first first subsidiary sound generator disposed on the first subsidiary area of the display panel, wherein the first first subsidiary sound generator generates a sound by vibrating the first subsidiary area of the display panel; and a second first subsidiary sound generator disposed on the second subsidiary area of the display panel, wherein the second first subsidiary sound generator generates a sound by vibrating the second subsidiary area of the display panel, wherein the first side extends in a first direction and the second side extends in a second direction crossing the first direction, the first direction and the second direction defining a plane in which an entirety of the main area is disposed therein, wherein the first subsidiary area and the second first subsidiary area are not disposed in the plane, and wherein the first side and the second side are disposed adjacently with a corner portion interposed therebetween.

18. The display device of claim 17, wherein the first first subsidiary sound generator is spaced apart from the second first subsidiary sound generator.

19. The display device of claim 17, further comprising:

a first subsidiary connection film which connects the first first subsidiary sound generator and the second first subsidiary sound generator to each other.

20. The display panel of claim 17, wherein the display panel further includes a first corner portion where the first subsidiary area of the display panel meets the second subsidiary area of the display panel, wherein the first first subsidiary sound generator is disposed on the first subsidiary area of the first corner portion, and the second first subsidiary sound generator is disposed on the second subsidiary area of the first corner portion.

21. The display device of claim 17, wherein the display panel further includes a third subsidiary area extending from a third side of the main area which faces the second side, and wherein the display device further comprises a second sound generator, wherein the second sound generator comprises:

a first second subsidiary sound generator disposed on the third subsidiary area of the display panel, wherein first second subsidiary sound generator generates a sound by vibrating the third subsidiary area of the display panel; and a second second subsidiary sound generator disposed on the first subsidiary area of the display panel, wherein the second second subsidiary sound generator generates a sound by vibrating the first subsidiary area of the display panel.

22. The display device of claim 21, further comprising:

a first subsidiary connection film which connects the first first subsidiary sound generator and the second first subsidiary sound generator to each other;

a second subsidiary connection film which connects the first second subsidiary sound generator and the second second subsidiary sound generator to each other; and a first connection film which connects the second first subsidiary sound generator and the first second subsidiary sound generator to each other, wherein the second first subsidiary sound generator is spaced apart from the first second subsidiary sound generator.

* * * * *